US005442426A

United States Patent [19]

Yamamura et al.

[11] Patent Number: 5,442,426

[45] Date of Patent: Aug. 15, 1995

[54] WET TYPE ELECTRO-PHOTOGRAPHIC RECORDING APPARATUS

[75] Inventors: Takashi Yamamura; Kazunori Namiki, both of Kanagawa; Toshiya Kobashi, Yokohama; Ryuji Horiuchi, Kanagawa, all of Japan

[73] Assignee: Victor Company of Japan, Ltd., Yokohama, Japan

[21] Appl. No.: 82,884

[22] Filed: Jun. 24, 1993

[30] Foreign Application Priority Data

Jun. 25, 1992 [JP] Japan ..... 4-191461
Jul. 27, 1992 [JP] Japan ..... 4-219707
Jul. 28, 1992 [JP] Japan ..... 4-219551

[51] Int. Cl.[6] ..... G03G 15/10
[52] U.S. Cl. ..... 355/256
[58] Field of Search ..... 355/256, 326, 327

[56] References Cited

U.S. PATENT DOCUMENTS

| | | | |
|---|---|---|---|
| 3,609,029 | 9/1971 | Egnaczak | 355/256 |
| 3,949,703 | 4/1976 | Smith et al. | 355/256 X |
| 4,208,121 | 6/1980 | Muller | 355/256 |
| 4,222,776 | 9/1980 | Tsukada et al. | 355/256 X |
| 4,270,859 | 6/1981 | Galbraith et al. | 355/256 X |
| 4,522,484 | 6/1985 | Landa | 355/256 |
| 4,663,257 | 5/1987 | Murasawa et al. | 355/256 X |
| 4,682,881 | 7/1987 | Komatsubara et al. | 355/256 X |
| 5,120,624 | 6/1992 | Takanashi et al. | 430/47 |

FOREIGN PATENT DOCUMENTS

| | | |
|---|---|---|
| 61-077866 | 4/1986 | Japan . |
| 62-144180 | 6/1987 | Japan . |
| 62-103067 | 7/1987 | Japan . |
| 02144554 | 6/1990 | Japan . |

*Primary Examiner*—Fred L. Braun
*Attorney, Agent, or Firm*—Michael N. Meller

[57] ABSTRACT

The present invention discloses a wet type electro-photographic recording apparatus having a simple structure and a high quality without uneven density, and capable of miniaturizing the apparatus. Around a rotary drum, an exposing section, a pre-bath treatment portion and a developing portion are disposed. The exposing section is disposed on an upstream region in a rotating direction of the rotary drum with respect to a lower extreme position of the rotary drum, and in an upper portion of the rotary drum. The pre-bath treatment portion is disposed at a position between the upper portion where the exposing section is disposed and the lower extreme position of the rotary drum. The pre-bath treatment portion has at least a supply section provided at a high level position for dropping pre-bath liquid and a pre-bath coating section provided in a lower level position for coating the dropped pre-bath liquid on the electro-photograph recording sheet, whereby the electro-photographic recording is pre-bathed by using the high insulating liquid having phase solubility with electrically insulating liquid used as a wet type developer. The developing section having a developing electrode is disposed substantially close to the rotary drum and in an upstream in the rotating direction of the rotary drum with respect to the lower extreme position of the rotary drum.

20 Claims, 29 Drawing Sheets

WET TYPE ELECTRO-PHOTOGRAPHIC RECORDING APPARATUS

BACKGROUND OF THE INVENTION

The present invention relates to a wet type electro-photographic recording apparatus and, particulally, to a wet type electro-photographic recording apparatus by which both a proof sheet and a planographic sheet can be obtained.

As the so-called "total printing system" by which a print is obtained through the steps of picking-up an image, editing, correcting, preparing block copy, preparing stencil and printing, the following system is known:

(1) A color photographic film bearing an original information is color-decomposed to obtain a plurality of colors necessary for a process printing by means of an image pick-up portion such as image scanner or drum scanner.

Then, a color separation film having a dot-image is prepared for each color and a plate is prepared on the basis of the color separation film and corrected.

Colors used for a process printing includes usually subtractive primaries, that is, yellow (Y), magenta (M) and cyan (C), and black (BL).

When a proof sheet prepared is not acceptable, the color separation films are corrected, retouched, edited and/or patched, etc., manually. The color separation films thus corrected are returned to the image pick-up portion as a secondary original information. This process is repeated until the proof sheet becomes acceptable.

When the proof sheet is acceptable, a final planographic sheet for printing is prepared on the basis of the color separation films. An actual printing is performed with using a stencil of the planographic sheet thus prepared.

(2) A color photographic film bearing an original information is color-decomposed to obtain a plurality of colors necessary for a process printing by means of an image pick-up portion such as image scanner or drum scanner, as in the same manner used in the system (1) mentioned above.

Then, digital image data obtained from the image pick-up portion correspondingly to dot-images of the respective colors are stored in a storage (MT or hard disk, etc.) of a work station.

In this work station, an image processing such as layout, color regulation and edition, etc., are performed by using the digital image data stored in the storage.

A result of this image processing is displayed on a display screen or output from a digital color printer and checked on the display screen or the output image. When it is acceptable, color separation films for a block copy are prepared by means of a photographic film output device or a recorder portion of a drum scanner, etc., for correction.

A final planographic sheet for printing is prepared on the basis of the color separation films thus corrected and a proof sheet is prepared.

When the proof sheet is not acceptable, it is informed to the work station to repeat the above processing.

When the proof sheet is acceptable, a final planographic sheet for printing is prepared on the basis of the color separation films.

An actual printing is performed with using a stencil of the planographic sheet thus prepared.

The conventional printing systems mentioned above are based on color separation films for correction and preparation of stencil, respectively.

It is known, however, that formation of color separation films takes considerably long time and requires considerable manual procedures.

Further, there are many problems in storing and managing color separation films. Further, the process of correction based on the color separation films is not easy and requires skilled persons.

In addition to these problems, these conventional systems require very expensive correcting machines and plate making machines.

Japanese Patent Application Laid-open No. H3-9888 discloses a printing system which has no such problems as mentioned above.

The disclosed system includes an image pick-up portion for separating color of an original image information into a plurality of colors necessary for a process printing and a storage of a work station for storing digital image data corresponding to images of respective colors or digital image data output correspondingly to dot-images of respective colors.

In the work station, a user performs image processing such as layout, color regulation and edition, etc., on a color image displayed on a display by using an image processor.

Thereafter, the user provides a result of processing to a proof and planographic output device to cause the latter to output a proof sheet and/or a planographic sheet according to the digital data corresponding to dot-images of respective colors or digital image data corresponding to a monochromatic dot-image.

According to the disclosed system, the problems inherent to the aforementioned total printing system are solved sufficiently.

However, since the disclosed system includes various separate constitutional portions, a device necessary for constituting the system becomes large and, since electro-photographic processing time is very long, it is easily affected by attenuation of light.

Further, due to the fact that there are many portions which are in contact with an electro-photographic recording medium and precise positioning is relatively difficult, it is difficult to obtain high repeating accuracy and out of register tends to become large, which are new problems to be solved.

Further, since, in the disclosed system, a developing process is performed after about one revolution of a drum pre-processed in pre-processing liquid bath, it takes long time. The pre-processing liquid tends to be dried, causing variation of concentration.

In the disclosed system, the pre-processing is performed with a roller being dipped in pre-processing liquid in a bath. Therefore, alien such as toner floating on a level of pre-processing liquid may be adsorbed on the roller.

Further, in a wet type electro-photographic device, residual developing agent on an electro-photographic recording sheet after passed through a developing device is unavoidable. If such residual developing agent is left as it is, quality of a resultant image is degraded. In order to remove such residual developing agent on the recording sheet, the latter is passed through a residual developing agent remover comprising such as blade device, corona squeeze device or air-knife device, etc.

Among others, the air-knife device has been used since it does not considerably disorder a toner image on an image carrier surface and its construction is relatively simple.

However, efficiency of removal of residual developing agent of the conventional air-knife device is not so high as necessary for sufficient removal of residual developing agent.

When, in order to improve the efficiency of residual agent removal, air pressure is increased by increasing an amount of air to be supplied to the air-knife device, the toner image on the image carrier surface may be damaged, the developing agent may be bubbled up and/or scattered and/or evaporation of developing agent may become too much.

BRIEF SUMMARY OF THE INVENTION

Object of the Invention

An object of the present invention is to provide a wet type electro-photographic recording apparatus which is compact and does not produce variation of concentration on a resultant image.

Another object of the present invention is to provide a wet type electro-photographic recording apparatus by which both a proof sheet and a planographic sheet can be obtained.

A still another object of the present invention is to provide an image recording apparatus in which a positional relation between a rotary drum and an electro-photographic sheet is stable and by which a full color image having minimum color deviation can be obtained.

A further object of the present invention is to provide an image recording apparatus in which non-uniformity of developer can be prevented by always applying fresh pre-processing liquid and uniformly painting with it.

Another object of the present invention is to provide an image recording apparatus in which there is no dark attenuation of charge and pre-processing liquid is hardly dried, so that concentration astability, non-uniformity of development and fogging of a resultant image are substantially minimized.

SUMMARY OF THE INVENTION

The present invention resides in an image recording apparatus for recording an image on an electro-photographic recording sheet by forming an electric charge image corresponding to an image to be recorded on the electro-photographic recording sheet and developing the electric charge image by wet type developer containing developer particles dispersed in an electrically insulating liquid. The image recording apparatus comprises:

an exposing portion disposed on an upstream side in a rotating direction of a rotary drum for carrying the electro-photographic recording sheet wound thereon with respect to a lower extreme portion thereof and in a side portion of the rotary drum; and a pre-bath treatment portion disposed in an upstream of the lower extreme portion of the rotary drum for pre-bath treating the electro-photographic recording sheet with high insulating liquid having phase solubility with the electrically insulating liquid.

The image recording apparatus further comprises a developing portion having developing electrodes and disposed in the vicinity of the lower extreme portion of the rotary drum such that the developing electrodes are positioned at least substantially in an area upstream with respect to the lower extreme position of the rotary drum.

The image recording apparatus further comprises an excess developer removing portion disposed on a downstream side with respect to the lower extreme portion of the rotary drum for removing an excess amount of the developer in the vicinity of the developing electrodes provided in the exposing portion by air pressure.

The present invention further resides in an image recording apparatus for recording an image on an electro-photographic recording sheet by forming an electric charge image corresponding to an image to be recorded on the electro-photographic recording sheet and developing the electric charge image by wet type developer containing developer particles dispersed in an electrically insulating liquid. The image recording apparatus comprises:

a rotary drum for carrying the electro-photographic recording sheet wound thereon;

means for leading a leading edge of the electro-photographic recording sheet supplied from a supply portion having a roll of the electro-photographic sheet and intimately holding the electro-photographic recording sheet cut to a predetermined size on the rotary drum;

an electric charger for uniformly charging the electro-photographic recording sheet wound on the rotary drum;

means for exposing, through an optical system, the uniformly charged electro-photographic recording sheet with a predetermined spot light obtained by intensity-modulating a laser light with predetermined exposing data containing spot matrix image digital data;

an exposing portion disposed on an upstream side in a rotating direction of a rotary drum for carrying the electro-photographic recording sheet wound thereon with respect to a lower extreme portion thereof and in a side portion of the rotary drum;

a pre-bath treatment portion disposed in an upstream of the lower extreme portion of the rotary drum for pre-bath treating the electro-photographic recording sheet with high insulating liquid having phase solubility with the electrically insulating liquid;

a developing portion having a developing electrode disposed at least substantially in an area upstream with respect to the lower extreme position of the rotary drum;

an excess developer removing portion disposed on a downstream side with respect to the lower extreme portion of the rotary drum for removing an excess amount of the developer in the vicinity of the developing electrode provided in the exposing portion by air pressure;

a thermal fixing portion;

a residual charge removing portion;

means for separating the recorded electro-photographic recording sheet from the rotary drum; and a controller for controlling operations of the rotary drum, the leading means, the electric charger, the exposing means, the exposing portion, the pre-bath treatment portion, the developing portion, the excess developer removing portion, the thermal fixing portion, the residual charge removing portion and the separating means.

BRIEF DESCRIPTION OF THE DRAWINGS

FIG. 11 is a drawing useful to explain an operation of the excess developer removing device according to an embodiment of the present invention;

FIG. 12 is a similar drawing to FIG. 11 for a case where the excess developer removing device is not provided;

wherein

DETAILED DESCRIPTION OF THE PREFERRED EMBODIMENT

An image recording apparatus according to the present invention will be described in detail with reference to the drawings.

Figure 1:
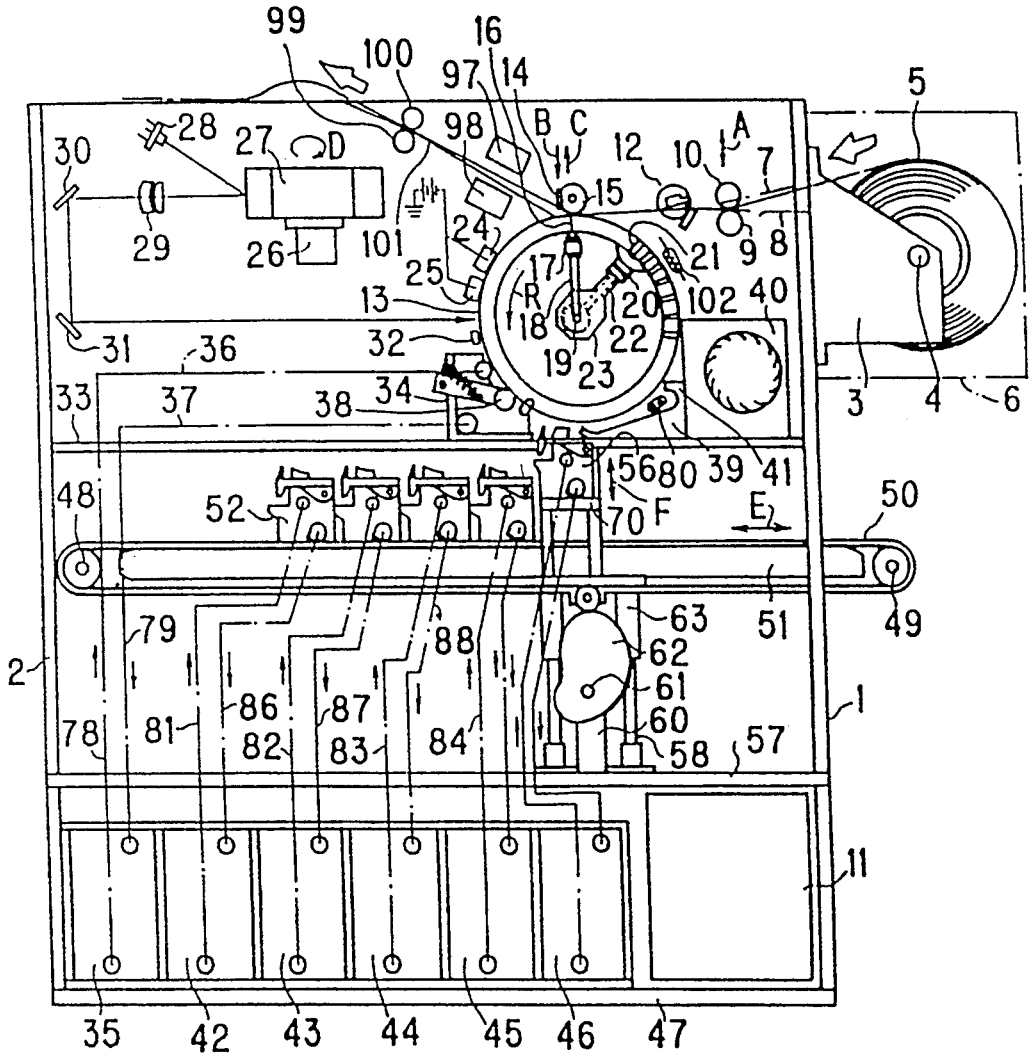
FIG. 1 is a partially cross sectioned side view of an embodiment of an image recording apparatus according to the present invention.

FIG. 1 is a partially cross sectioned side view showing schematically a construction of an image recording apparatus according to the present invention.

In FIG. 1, reference numerals 1 and 2 depict side plates of a main body of the image recording apparatus, respectively. A pair of parallel bearing plates 3 are fixedly secured to an upper portion of the side plate 1, for rotatably supporting opposite end portions of a rotary shaft 4 of a roll of an electro-photographic recording sheet 5, respectively.

The electro-photographic recording sheet 5 is composed of an electrically conductive support sheet and a photo-sensitive layer formed on the conductive support sheet. The photo-sensitive layer is formed of an electrically insulating resin binder in which photo-conductive titanium dioxide is dispersed.

The roll of the electro-photographic recording sheet 5 is shielded by a shielding member 6 shown by an imaginary line in FIG. 1.

Width of the electro-photographic recording sheet 5 which may be any is detected by a sensor which is not shown and an output signal of the sensor indicative of the width is supplied to a controller 11 in which operating conditions such as initial settings of various parameters including setting of sheet width to be developed which are required in the successive steps are performed based on the detected width.

In order to start an image recording by means of the image recording apparatus, an operator inputs to an input portion (not shown) a start information of recording, upon which the electro-photographic recording sheet 5 is derived from the sheet roll and supplied into between supply rollers 9 and 10 through a space between guide plates 7 and 8.

The electro-photographic recording sheet 5 is then supplied onto a rotary drum 13 by means of the supply rollers 9 and 10 under control of the controller 11.

That is, the supply roller 9 has a role of a driving roller and the supply roller 10 is a driven roller.

The driven roller 10 is supported such that it can rotate in an arrow direction A in FIG. 1. The supply roller 9 is rotated by torque transmitted from a drive motor whose operating timing is controlled by the controller 11 to pinch, together with the roller 10, a leading edge of the electro-photographic recording sheet 5 and move it through a cutter 12 in a rest state to the rotary drum 13.

The supply rollers 9 and 10 and the driving motor therefor are constituted as a unit block and the block can be removed easily from the apparatus by pulling it from the drawing sheet.

The cutter 12 may have any construction including a rotary edge and a stationary edge.

The cutter 12 serves to cut the electro-photographic recording sheet 5 when it is driven by a drive motor under control of the controller 11, as to be described later.

The cutter 12 is also constructed as a unit which can be easily removed from the image recording apparatus by pulling it out in the direction normal to the drawing sheet.

When the supply of the electro-photographic recording sheet 5 is started by the supply rollers 9 and 10, a start position limiter 14 provided above the rotary drum 13 is moved down onto the surface of the rotary drum 13.

At this time, the rotary drum itself is held in a rest state in the position as a reference rotational phase by a cam (not shown) operable under control of the controller 11.

The leading edge portion of the electro-photographic recording sheet 5 is advanced with rotation of the supply rollers 9 and 10 and, when it contacts with the start position limiter 14, a signal is produced by a sensor which is not shown and supplied to the controller 11.

Further, a pressure roller 15 is moved in the direction shown by an arrow B by a cam (not shown) to press the leading edge portion of the electro-photographic recording sheet 5 onto the rotary drum 13.

A shallow groove extending in parallel to an axis of the rotary drum is formed in a portion of the surface of the rotary drum 13 which is to be covered by the leading edge portion of the electro-photographic recording sheet 5. A number of orifices 16 are formed in the groove, which are communicating with a sucking holes 17 of a sucking device provided within an inner space of the rotary drum 13.

The sucking hole 17 is connected to a vacuum pump (not shown) through a tube 18 and an interior of a hollow rotary shaft 19 of the rotary drum 13.

The controller 11 responds to the signal produced by the sensor (not shown) at the time when the leading edge portion of the electro-photographic recording sheet 5 becomes in contact with the start position limiter 14 to cause a sucking operation to occur by the vacuum pump at a predetermined timing.

Therefore, the leading edge portion of the electro-photographic recording sheet 5 is attracted to the peripheral surface of the rotary drum 13.

This operation is started after the leading edge portion of the electro-photographic recording sheet 5 contacts with the start position limiter 14 and the pressure roller 15 moves down in the direction of arrow B and presses the electro-photographic recording sheet 5 onto the peripheral surface of the rotary drum 13.

As mentioned, immediately after the leading edge portion of the electro-photographic recording sheet 5 is in intimate plane-contact with the peripheral surface of the rotary drum 13, the start position restricting member 14 rises under control of the controller 11 as shown by an arrow C.

The rotary drum 13 whose surface contacts intimately with the electro-photographic recording sheet 5 starts to rotate in the direction shown by an arrow R, under control of the controller 11 to thereby wind the electro-photographic recording sheet 5 thereon.

That is, since the electro-photographic recording sheet 5 is held in intimate contact with the surface of the rotary drum 13 due to the suction operation and is pressed onto the surface of the rotary drum 13 by the pressure roller 15, it is continuously wound on the rotary drum 13 with rotation thereof.

As a result, the electro-photographic recording sheet 5 wound on the rotary drum 13 becomes an intimate contact with the surface thereof.

The start position limiter 14, the pressure roller 15 and a lifting mechanism therefor are constructed as a unit which can be removed from the apparatus by pulling it out in the direction normal to the drawing sheet.

A concrete construction and operation of a head positioning device for setting a leading edge of the electro-photographic recording sheet with respect to the rotary drum will be described with reference to FIGS. 13 to 19.

In FIGS. 13, 14, 18 and 19 which are partially cross sectioned front views around a head positioning mechanism HP of the head positioning winding device for positioning a head or leading edge of the electro-photographic recording sheet according to the present invention, respectively, reference numerals 201 and 202 depict side plates of the apparatus.

The head positioning mechanism HP for positioning the leading edge of the electro-photographic recording sheet is constructed detachably with respect to the image recording apparatus.

Connecting rods 230 and 231 connecting a left constitutional portion and a right constitutional portion of the head positioning mechanism HP are supported by rail members 228 and 229 fixedly secured to the side plates 201 and 202 and inserted into holes 221 and 222 provided in the side plates 201 and 202, respectively. Therefore, the head positioning mechanism HP can be derived from either of the side plates easily.

When the head positioning mechanism HP is mounted by inserting it from one of the side plates, a positioning pin 227 (FIG. 13) mounted on a top end of the connecting rod 230 is fitted in a positioning hole provided in a positioning block 226 fixedly secured to the side plate 202. Thus, a position of the head positioning mechanism HP can be fixedly determined with respect to the recording apparatus. Then, by securing the head positioning mechanism HP to the side plate 201 by tightening screws 233 to 235 (FIG. 18), the head positioning mechanism HP is fixedly mounted on the image recording apparatus.

Figure 13:
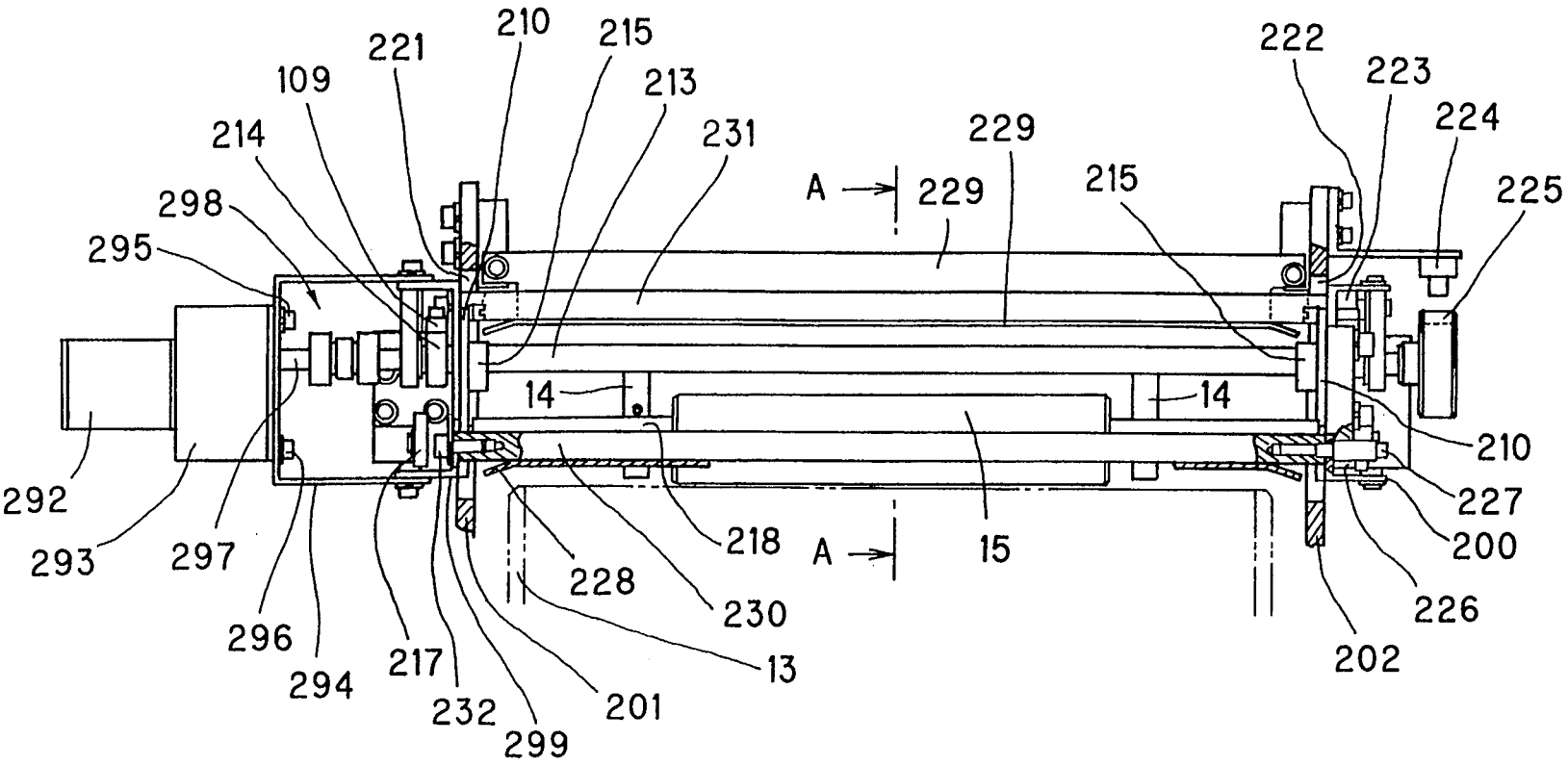
FIG. 13 is a partially cut away front view of a portion including a recording sheet leading mechanism of a leading and winding device of a recording sheet in the present image recording apparatus.

In FIG. 13, reference numerals 292, 293 and 298 depict a motor, a reduction gear box and a coupling portion, respectively, and the reduction gear box 293 is fixedly secured to a power source mounting plate 294 by screws 295 and 296.

A reference numeral 297 depicts an output shaft of the reduction gear box, which is coupled to a cam shaft 213 through the coupling portion 298.

Figure 18:
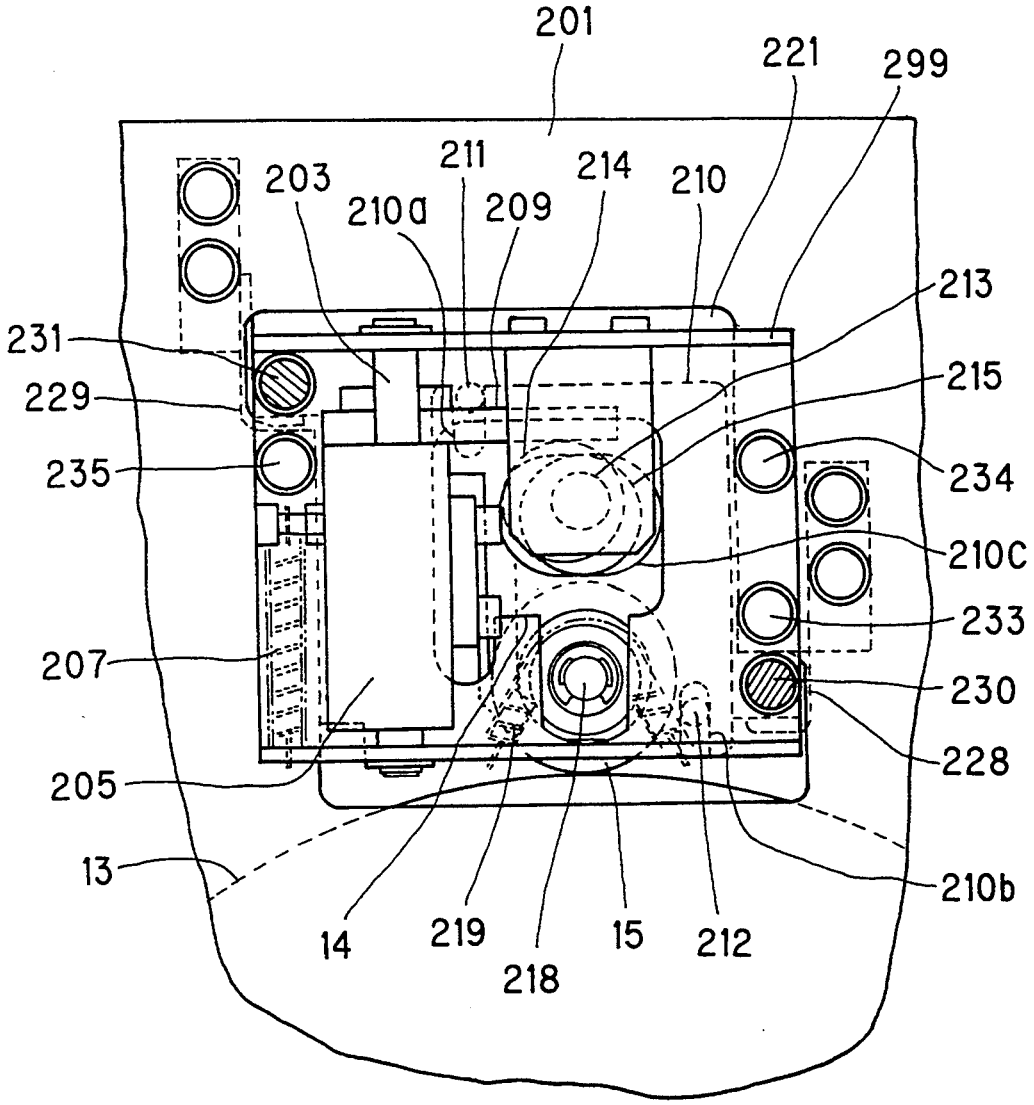
FIG. 18 is a side view of a main portion of the recording sheet leading mechanism useful to explain an operation for mounting it on and demounting it from the main body of the present image recording apparatus.
Figure 19:
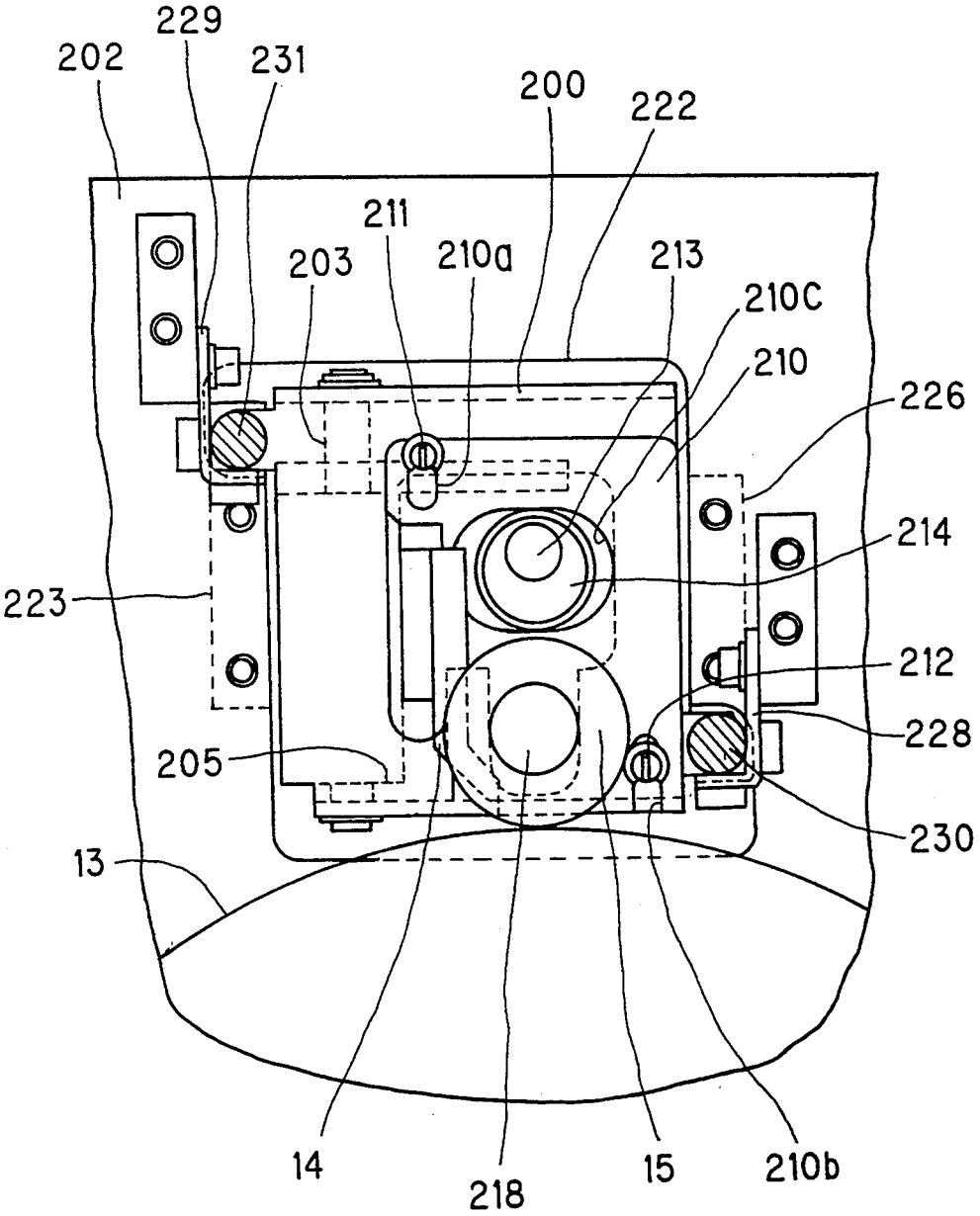
FIG. 19 is a similar view to FIG. 18, with a portion thereof being removed.

FIG. 19 is a side view taken along a line A—A in FIG. 13 and FIG. 18 is a side view of the side plate 201 of the image recording apparatus.

Figure 14:
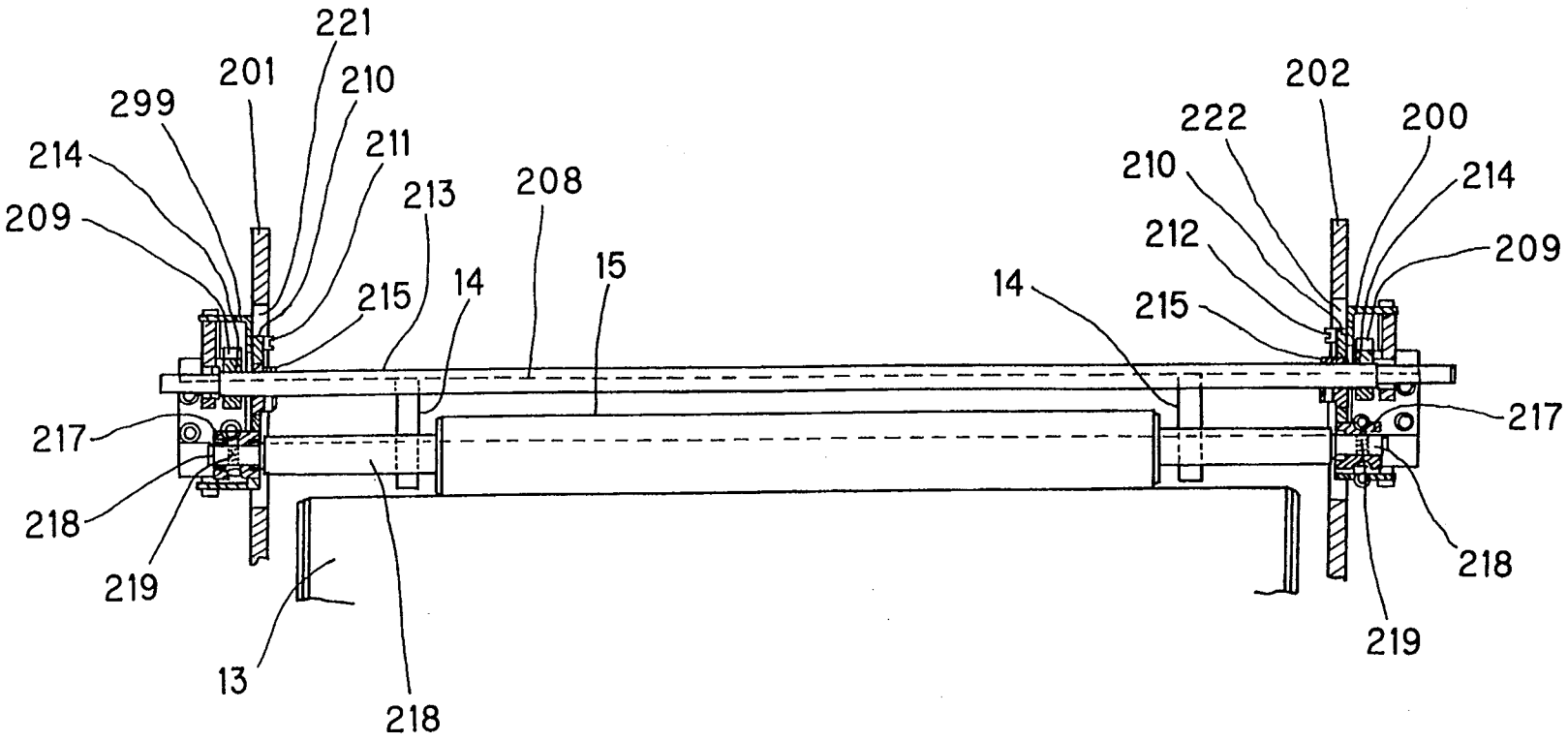
FIG. 14 is a similar view to FIG. 13, with a portion in FIG. 13 being removed.

FIG. 14 corresponds to FIG. 13, showing the mechanism in a simplified form by removing the motor 292, the reduction gear box 293, the coupling portion 298, the positioning block 226, a sensor 224, a dog 225 on which a pattern to be detected by the sensor 224 is formed and the guide rails 228 and 229, etc.

Figure 15:
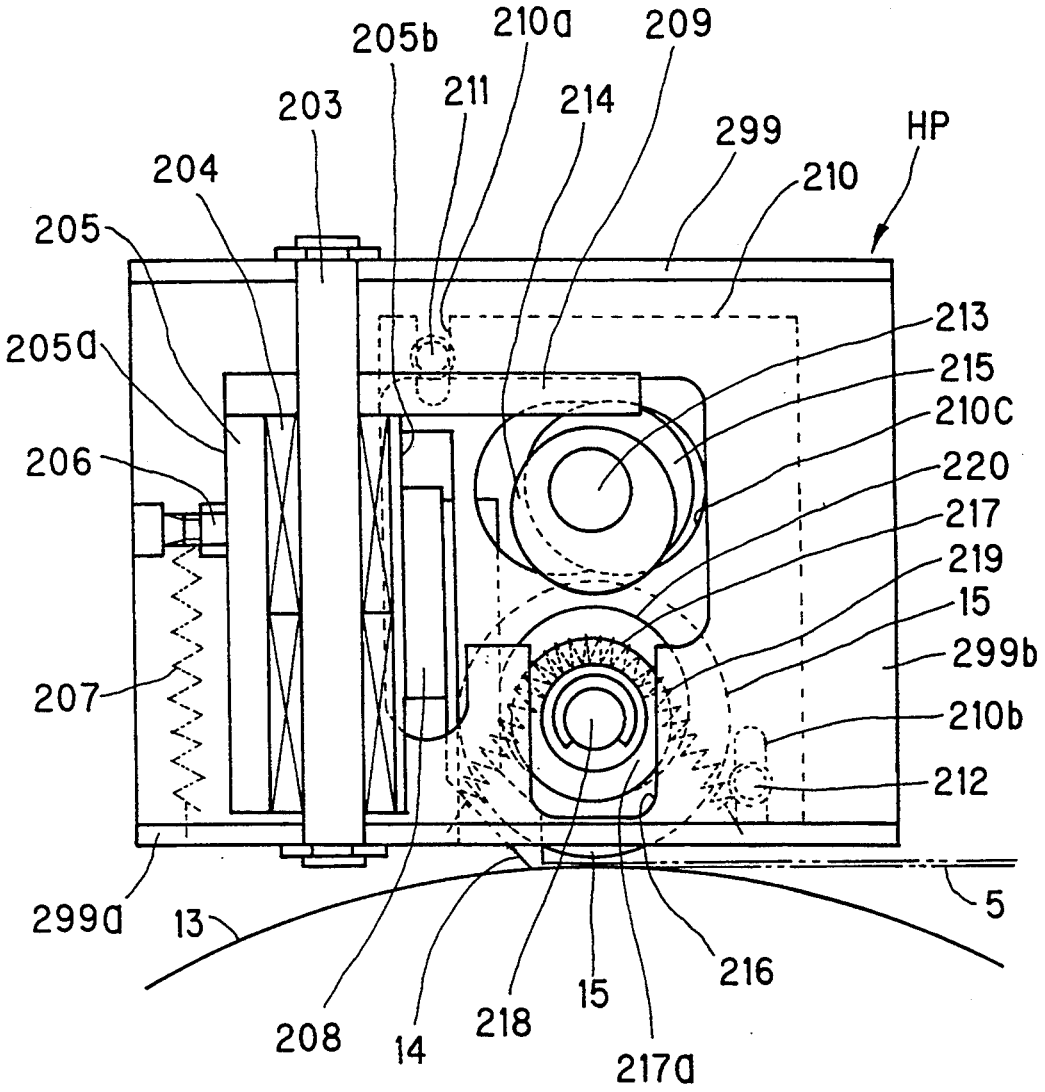
FIG. 15 is a left side view of the recording sheet leading mechanism shown in FIG. 14, showing a start position limiting member 14 of the recording sheet leading mechanism shifted up to a surface of a rotary drum.
Figure 16:
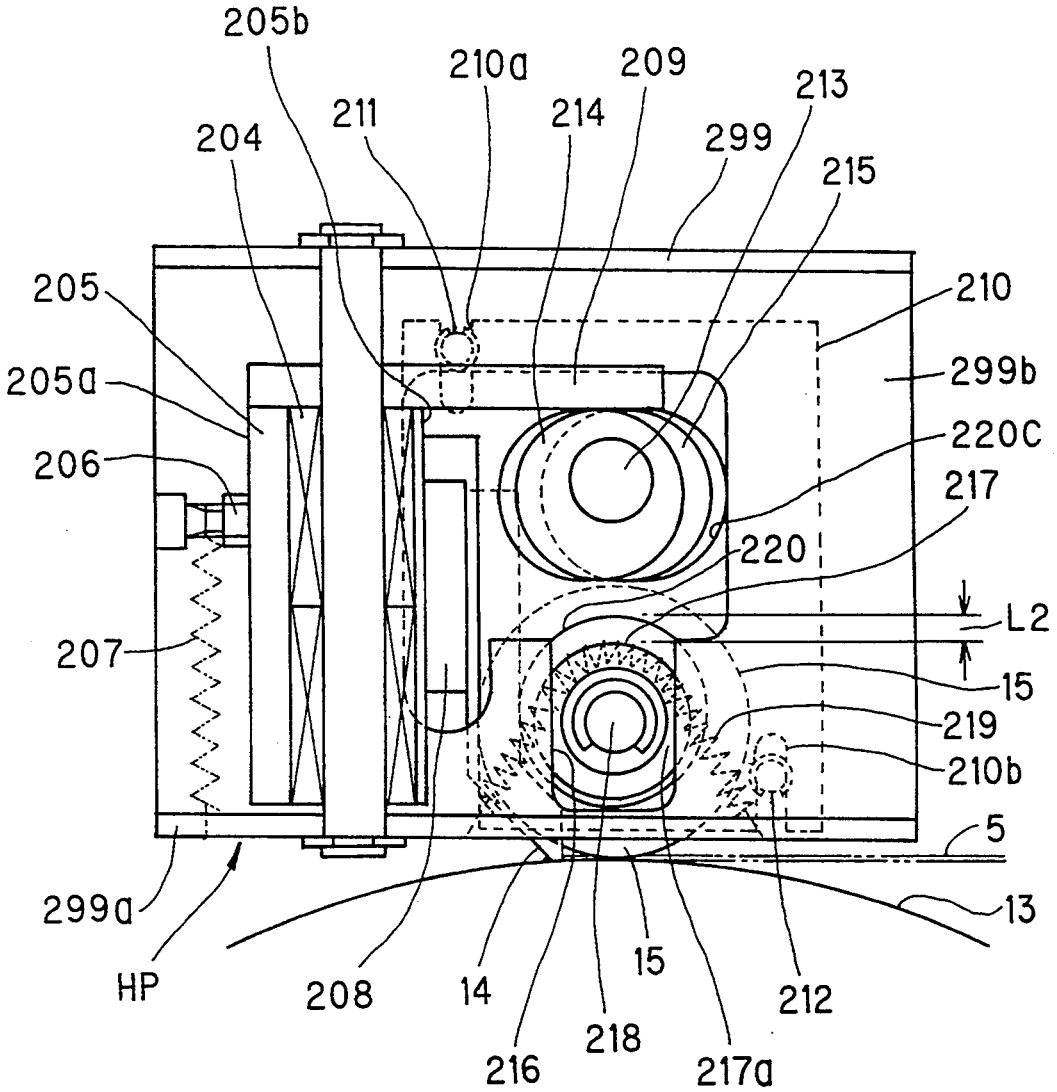
FIG. 16 is a similar view to FIG. 15, showing a recording sheet pressing roller 15 shifted up to the surface of the rotary drum.
Figure 17:
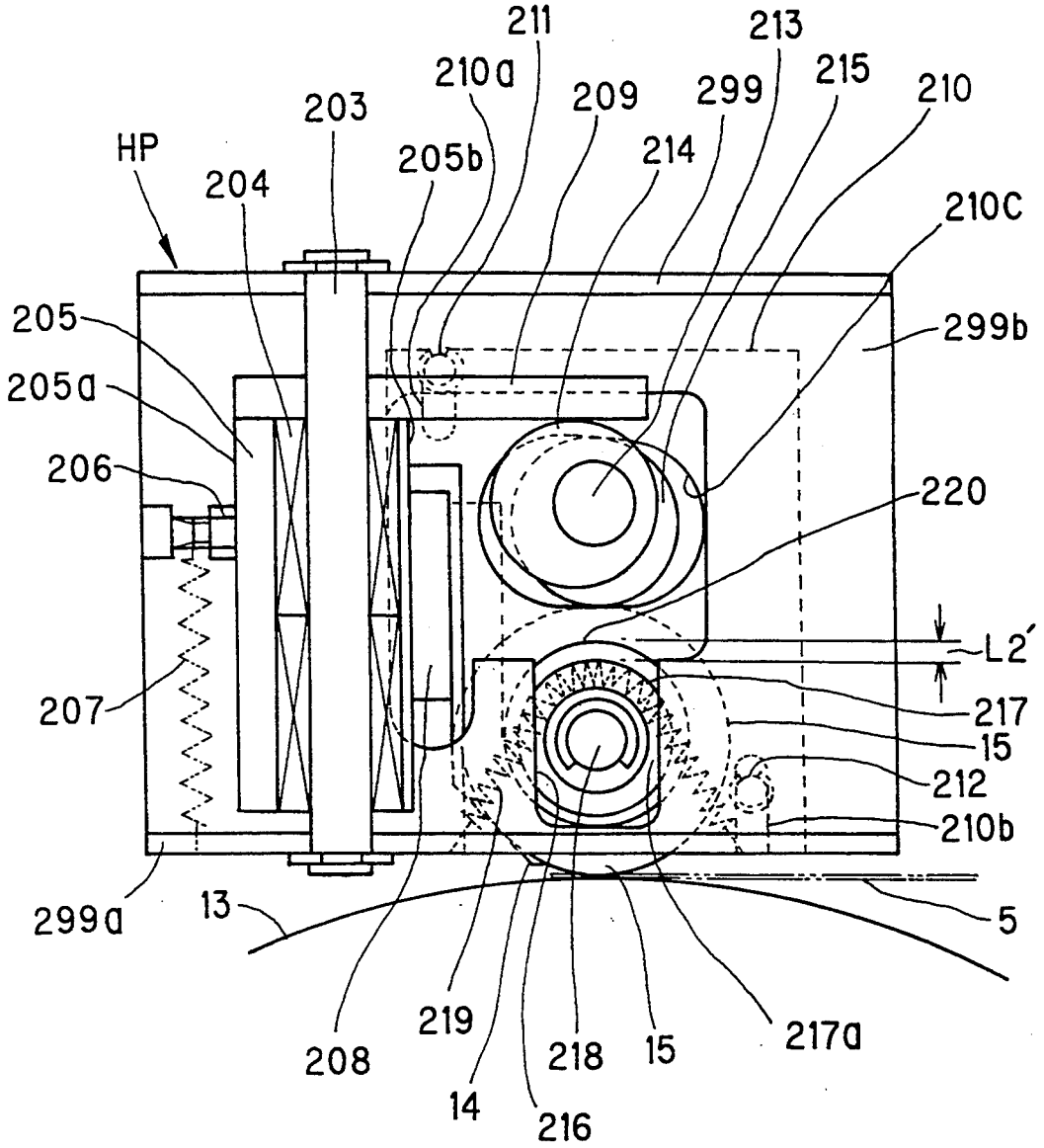
FIG. 17 is a similar view to FIG. 16, showing the start position limiting member 14 of the recording sheet leading mechanism separated from the surface of the rotary drum.

FIGS. 15 to 17 are side views of the head positioning mechanism HP of the head positioning winding device shown in FIG. 14, illustrating an operation of the head-positioning mechanism HP.

In FIG. 15, a supply of the recording sheet 5 is started by the supply rollers 9 and 10 under control of the controller 11 and the recording sheet leading edge position restricting member 14 of the head positioning mechanism HP provided above the rotary drum 13 is in a rest state showing a reference rotational phase.

In this state, the recording sheet leading edge position restricting member 14 is lowered until its leading edge becomes in contact with the surface of the rotary drum 13 and the recording sheet 5 is driven by the supply rollers 9 and 10 driven by a motor such as stepping motor (not shown).

That is, the leading edge of the recording sheet 5 positioned stationarily in a position of the stationary receiving edge **12*b* of the cutter 12 is moved from the position of the stationary receiving edge 12*b* of the cutter 12 by a distance slightly longer than a distance between the position of the receiving edge 12*b* and the recording sheet leading edge restricting member 14** of the head positioning mechanism HP.

In this state, a predetermined number of pulses are supplied from the controller 11 to the stepping motor so that head positioning is performed while the leading edge of the recording sheet 5 is reliably pressed to the recording sheet leading edge position restricting member 14 of the head positioning mechanism HP.

FIG. 16 shows a state where, after the leading edge of the recording sheet 5 is reliably pressed onto the recording sheet leading edge position restricting member 14, the recording sheet pressing roller 15 is lowered to press the sheet 5 on the outer peripheral surface of the rotary drum.

FIG. 17 shows a state where, after the leading edge of the recording sheet 5 is reliably pressed onto the recording sheet leading edge position restricting member 14 and the head positioning of the recording sheet 5 is reliably performed, the recording sheet pressing roller 15 is lowered to press the sheet 5 on the outer peripheral surface of the rotary drum.

In this state, the leading edge portion of the recording sheet 5 is attracted to a leading edge portion attracting area Zb of the outer peripheral surface of the rotary drum 13 by the action of the sucking hole 16 communicated with the sucking device provided within the rotary drum 13.

Thereafter, the recording sheet leading edge position restricting member 14 is risen under control of the controller 11 and the rotary drum 13 starts to rotate under the control of the controller 11.

The head positioning mechanism HP shown in FIGS. 15 to 17 is constituted with portions mounted on frames 299 and 200 having generally fallen U shape cross section and positioned in the vicinity of the side plates 201 and 202 as shown in FIGS. 13 and 14, a connecting plate 208 connecting members of these portions and the recording sheet leading edge position restricting member 14.

In FIGS. 13 to 17, a sliding member 205 mounting a ball bushing 204 thereon is slidably mounted on a shaft 203 fixedly secured to the frame 299 (200).

A reference numeral 206 depicts a pin implanted to one of side walls of the sliding member 205. A spring 207 is provided between the pin 206 and a base plate **299*a* of the frame 299 (200) so that the sliding member 205 is always biased toward the base plate of the frame 299 (200**).

An engaging member 209 is fixedly secured to an upper end of the sliding member 205 and an end of the connecting plate 208 is fixedly secured to the other side wall of the sliding member 205.

The recording sheet leading edge position restricting member 14 is fixedly secured to the connecting plate 208 as mentioned previously.

When the sliding member 205 slides along the shaft 203, an end of the position restricting member 14 mounted on the connecting plate 208 which, in turn, fixedly secured to the sliding member 205 is forced to contact with the outer peripheral surface of the rotary drum 13 or separated therefrom.

The sliding motion of the sliding member 205 along the shaft 203 is caused by deviation of the engaging member 209 fixedly secured to the upper end of the sliding member 205 by a motion of a cam plate 214 fixedly mounted on a cam shaft 213 eccentrically.

A cam plate 215 is also fixedly mounted on the cam shaft 213, eccentricity of which is different from that of the cam plate 214.

The cam plate 215 is fitted in a long slot **210*c* formed in a pressure roller position control plate 210**.

The pressure roller position control plate 210 is formed with a guide groove **210*a* engaged with a pin 211 implanted to the side plate 201 and a guide groove 210*b* engaged with a pin 212 implanted to the side plate 201. Therefore, when the cam plate 215 rotates in the long slot 210*c* according to rotation of the cam shaft 213, the pressure roller position control plate 210 is deviated longitudinally of the guide grooves 210*a* and 210*b* due to the engagements between the guide grooves 210*a* and 210*b* and the pins 211 and 212**.

The pressure roller position control plate 210 is formed with a hole 220 through which a roller shaft support 217 for supporting an end portion of the rotary shaft 218 of the pressure roller 15 passes.

Further, the roller shaft support 217 is biased toward the base plate **299*a* of the frame 299 (200) by a spring 219 having both ends fixed to the base plate 299*a***.

In the shown embodiment, the cam plates 214 and 215 are fixed to the cam shaft 213 with difference of eccentricity of 90 degree. With a rotational angle of the cam shaft 213 shown in FIG. 15, the cam plate 214 is separated from the engaging member 209 fixed to the upper end of the sliding member 205. In this case, the pressure roller position control plate 210 is deviated upwardly by the engagement between the cam plate 215 and the long slot **210*c* of the pressure roller position control plate 210**.

In the state of the cam shaft 213 shown in FIG. 15, the sliding member 205 is lowered by the spring 207.

Therefore, the recording sheet leading edge position restricting member 14 mounted on the connecting plate 208 which is, in turn, fixed to the sliding member 205 is lowered until its end becomes in contact with the surface of the rotary drum 13 in the rest state corresponding to the reference rotational phase.

Further, when the cam shaft 213 is in the state shown in FIG. 15, the pressure roller position limiting plate 210 deviated upwardly by the cam plate 215 engaged with the long slot 210*c* is separated from the recording sheet pressure roller 15 and the outer peripheral surface of the rotary drum 13 since the lower end of the roller shaft support 217 is pushed up by the lower end of the hole 220 of the support 217.

Therefore, in the state shown in FIG. 15, the head positioning is performed for the recording sheet 5.

FIG. 16 shows a state where the cam shaft 213 is rotated from the state shown in FIG. 15 in clockwise direction by 45 degree.

The cam plate 214 fixed to the cam shaft 213 starts to contact with the engaging member 209 fixed to the upper end of the sliding member 205.

In this state, the end of the recording sheet leading edge position restricting member 14 is still held in contact with the surface of the rotary drum 13 in the rest state corresponding to the reference rotational phase.

Further, the pressure roller position control plate 210 is deviated downwardly by the engagement between the long slot 210*c* formed in the pressure roller position control plate 210 and the cam plate 215.

Therefore, the roller shaft support 217 is lowered within the hole 220 by the spring 219, so that the recording sheet pressure roller 15 is made in contact with the outer peripheral surface of the rotary drum 13.

Thus, the recording sheet 5 is made in pressure-contact with the outer peripheral surface of the rotary drum 13 by the recording sheet pressure roller 15, with the leading edge thereof being restricted in position.

In this state, the leading edge portion of the recording sheet 5 is attracted to the surface of the rotary drum 13 by the action of the sucking holes 16 as to be described in detail later.

Figure 20B:
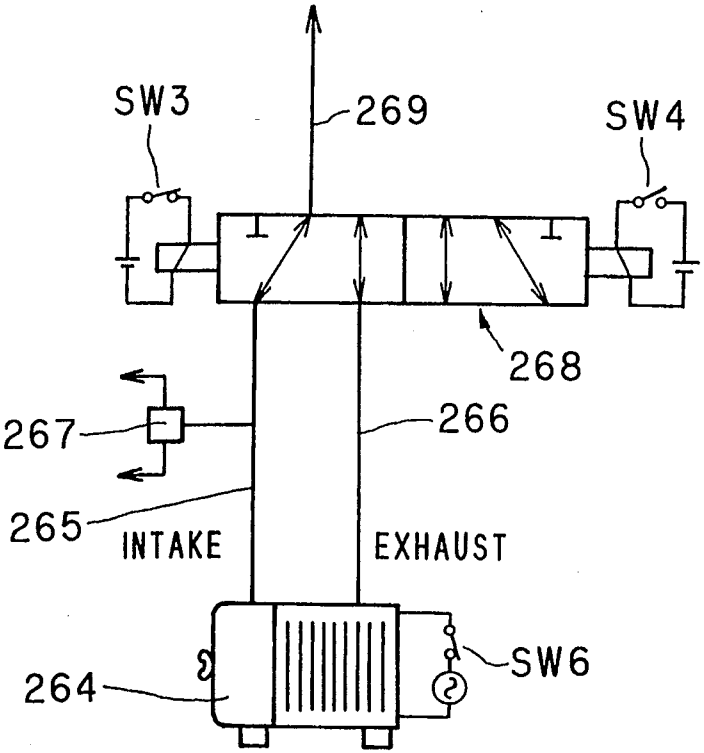
FIGS. 20(*a*) and 20(*b*) are drawings for explaining an operation of a vacuum adhesion device of the present image recording apparatus.
Figure 20A:
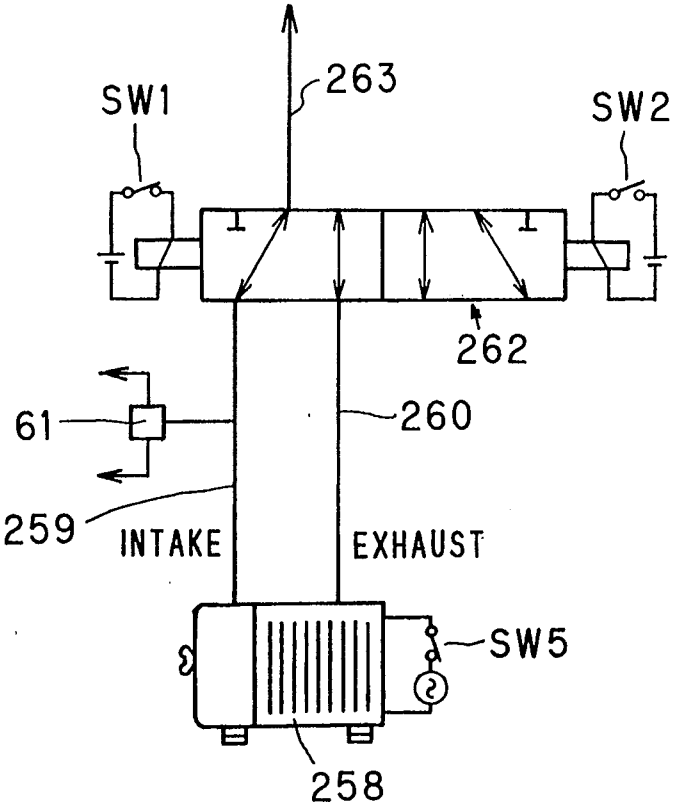

When this state is detected by a vacuum switch 61 shown in FIG. 20(*a*), the cam shaft 213 is rotated to the state shown in FIG. 17 under control of the controller 11 and the engaging member 209 is lifted up by the cam plate 214. Therefore, the sliding member 205 to which the engaging member 209 is fixed slides upwardly along the shaft 203.

The recording sheet leading edge position restricting member 14 is also moved upwardly through the connecting plate 208 fixed to the other side wall of the sliding member 205 and the top end of the recording sheet leading edge position restricting member 14 is separated from the outer peripheral surface of the rotary drum 13.

In response to the rotation of the cam shaft 213, the cam 215 is rotated with its engagement with the long slot 210*c* of the pressure roller position control plate 210.

Therefore, the pressure roller position control plate 210 is moved down from the position shown in FIG. 16, resulting in that a distance L2′ between the top portion of the roller shaft support 217 and the top portion of the hole 220 of the pressure roller position control plate 210 becomes small than a distance L2 between the the top portion of the roller shaft support 217 and the top portion of the hole 220 of the pressure roller position control plate 210 in the case shown in FIG. 16.

In this state, the recording sheet pressure roller 15 is held in contact with the outer peripheral surface of the rotary drum 13.

When the rotary drum 13 rotates from the above mentioned state, the recording sheet 5 of a predetermined length is wound on the outer peripheral surface of the rotary drum 13 under pressure of the recording sheet pressure roller 15 until the end portion of the recording sheet 5 is attracted onto the surface of the rotary drum 13 by the action of the sucking hole 17 through the through-holes as to be described in detail later.

When this state is detected by the vacuum switch 61 shown in FIG. 20(*a*), the cam shaft 213 is rotated in clockwise direction from the state shown in FIG. 17 under control of the controller 11 to push up the engaging member 209 by rotation of the cam plate 214. Further, with the rotation of the cam plate 215, the pressure roller position control plate 210 is pushed up.

With this upward movement of the engaging member 209, the recording sheet leading edge position restricting member 214 is also moved upwardly through the connecting plate 208 fixed to the other side wall of the sliding member 205 which moves together with the engaging member 209.

The top portion of the recording sheet leading edge position restricting member 14 is completely separated from the outer peripheral surface of the rotary drum 13 and moves above the pressure roller position control plate 210 by the upward movement of pressure roller position control plate 210 while the lowest portion of the roller shaft support 217 is held in engagement with a bottom of the hole 220 of the pressure roller position control plate 210.

When it is further pushed up against the spring 219, the recording sheet pressure roller 15 is also moved upwardly and separated from the outer peripheral surface of the rotary drum 13.

Therefore, the recording sheet leading edge position restricting member 14 and the recording sheet pressure roller 15 do not make any obstacle for the subsequent electro-photographic process.

As mentioned, the electro-photographic recording sheet 5 wound on the rotary drum 13 is cut by the cutter 12 operating under control of the controller 11 into a sheet having longitudinal size necessary for image recording.

A rear edge portion of the electro-photographic sheet 5 thus cut is held in contact with the surface of the rotary drum 13 by negative pressure given by a number of through-holes 21 communicating with a sucking hole 20 of a suction device.

That is, shallow grooves extending in parallel to the axis of the rotary drum 13 are formed in an area of the surface of the rotary drum 13 which is to be covered by the rear edge portion of the electro-photographic recording sheet 5 which is cut. The positions of these shallow grooves substantially correspond to length of individual electro-photographic recording sheets, respectively. The through-holes 21 are formed in each of these grooves, which are to be communicated with the sucking holes 20 of the suction device, which is connected to the vacuum pump, not shown, through a flexible tube 22 and a hollow path formed in the rotary shaft 19 of the rotary drum 13 to apply negative pressure to the rear surface of the electro-photographic recording sheet 5 to thereby attract the sheet 5 to the peripheral surface of the sheet 5.

Reference numeral 23 depicts a mechanism for moving the sucking hole 20 provided at a top end portion of the flexible tube 22 to any of the grooves having the through-holes 21 to be determined correspondingly to the size of electro-photographic recording sheet 5.

Figure 21:
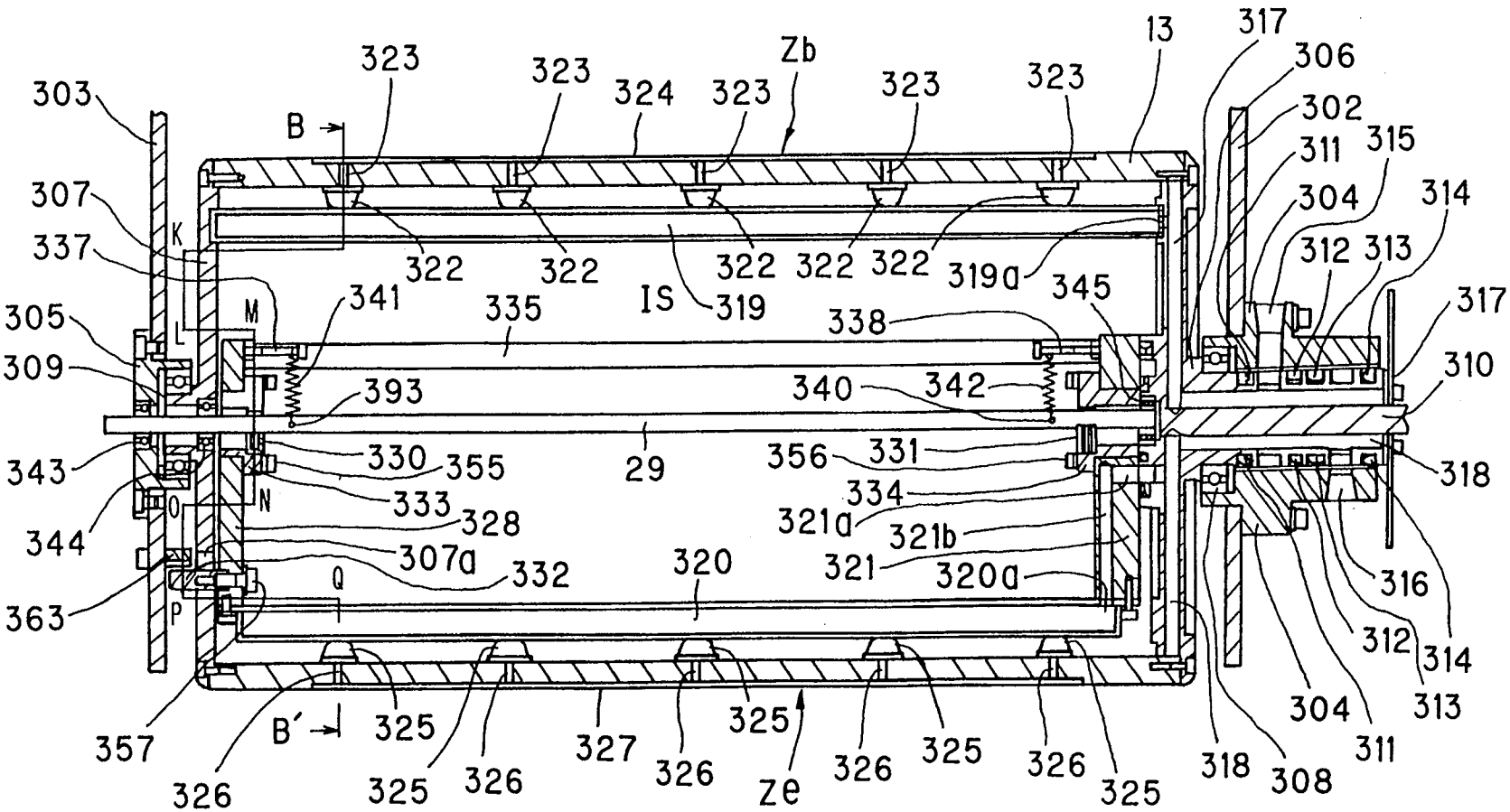
FIG. 21 is a cross section taken along a line A–A' in FIG. 22, showing a rotary drum portion having a recording sheet holding device according to an embodiment of the present image recording apparatus.

In FIG. 21, reference numerals 302 and 303 depict side plates of the image recording apparatus. Bearing portions 304 and 305 are fixedly secured to the side plates 302 and 303, respectively. Side end portions 306 and 307 of the rotary drum 13 are rotatably supported by bearings 308 and 309 provided in the bearing portions 304 and 305, respectively.

The bearing portion 304 fixedly secured to the side plate 302 and the side end portion 306 of the rotary drum 13 are air-tightly partitioned by packings 311 to 314 of such as rubber.

Therefore, when the rotary shaft 310 is driven by a power source (not shown), the side end portion 306 of the rotary drum 13 which is constituted integrally with the rotary shaft 310 rotates the rotary drum 13 at a predetermined speed while maintaining communication of sucking ports 315 and 316 provided in the bearing portion 304 fixed to the side plate 302 with air passages 317 and 318 constituted in the side end portion 306 of the rotary drum 13.

The air passage 317 is in communication with the air passage 319 formed in the internal space IS in the rotary drum 13 through a hole 319*a*.

The air passage 318 is in communication with an air tube 320 provided in the internal space IS in the rotary drum 13 through air passages 321*a* and 321*b* in a movable air passage member 321 provided in the internal space IS and a hole 320*a*.

The air tube 319 is fixedly arranged in the internal space IS of the rotary drum 13 in a position corresponding to the leading portion attracting area Zb which is common for all of variously sized recording sheets to be held on the outer peripheral surface of the rotary drum 13. In this case, the respective end portions of the air tube 319 are fixed to the side end portions 306 and 307 of the rotary drum 13.

An interior of the air tube 319 is connected to a shallow groove 324 provided in the leading edge attracting area Zb through an internal space of a sucking disc 322 and a through-hole 323 formed in the rotary drum 13. The shallow groove 324 has a width smaller than the width of the recording sheet 5 and extends in parallel to the axis of the rotary drum 13.

The air tube 320 has one end fixedly connected to the movable air passage member 321 and the other end fixed to the movable member 328 in the internal space IS of the rotary drum 13 corresponding to the trailing edge portion attracting area Ze set in the rotary drum 13 for the trailing edge portions of the variously sized recording sheets to be held on the outer peripheral surface of the drum.

An interior of the air tube 320 is selectively connectable to one of shallow grooves 327 provided in the trailing edge attracting area Ze through an internal space of a sucking disc 325 of elastic material and a through-hole 326 formed in the rotary drum 13. Each shallow groove 327 has a width smaller than the width of the recording sheet 5 and extends in parallel to the axis of the rotary drum 13.

A reference numeral 329 depicts a rotary shaft provided at a center axis of the rotary drum 13.

The rotary shaft 329 is rotatably supported by bearings 344 and 345 provided in the side end portions 306 and 307 of the rotary drum 13 and is supported rotatably by a bearing 343 of the bearing portion 305 of the side plate 302.

Circular discs 330 and 331 are fixedly mounted eccentrically on both end portions of the rotary shaft 329 within the internal space IS of the rotary drum 13, respectively. The eccentricity of the discs 330 and 331 are mutually different.

The disc 330 (331) engages with an inner periphery of a cam hole 354 formed in a cam plate 333 (334). The cam plate 333 is fixedly secured to the movable member 328 by a screw 355. The cam plate 334 is fixedly secure to the movable air passage member 321 by a screw 356.

Figure 22:
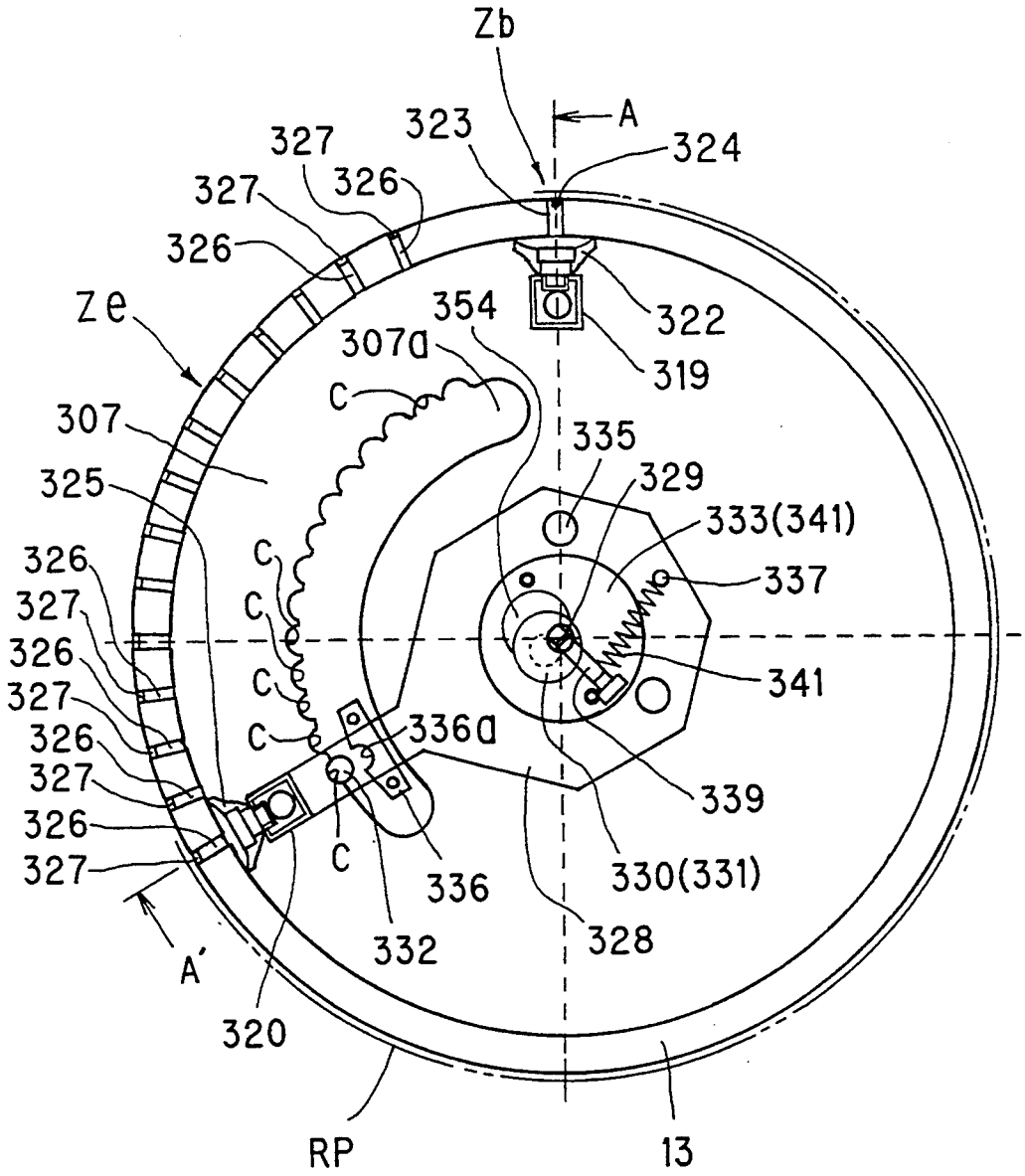
FIG. 22 is a perspective view of a cross section taken along a line B–B' in FIG. 21.

FIG. 22 is a cross section taken along a line B–J–K–L–M–N–O–P–Q–B′ in FIG. 21.

In FIG. 22, a spring 341 is provided between a pin 337 implanted in the movable member 328 and a pin 339 implanted in the rotary shaft 329 and a spring 342 is provided between a pin 338 implanted in the movable air passage member 321 and a pin 340 implanted in the rotary shaft 329.

FIG. 22 shows a relationship between the leading edge portion and a trailing edge portion of the recording sheet RP which is the smallest recording sheet 5 and the leading edge attracting area Zb and the trailing edge attracting area Ze of the rotary drum 13 having the recording sheet RP thereon.

In the state shown in FIG. 22, the engaging member 332 having a circular cross section and fixed to the movable member 328 by a screw 357 is in engagement with lowest one of semi-spherical engaging portions c formed in an edge portion of a through-hole 307*a* formed in the side end portion 307 of the rotary drum 13.

In this state, the sucking disc 825 of elastic material is held in communication with the through-holes 326 in one of the axially extending shallow grooves 827 whose width is smaller than the width of the recording sheet and which is in a specific position in the trailing edge attracting area Ze corresponding to the trailing edge of the smallest recording sheet RP.

An operation of the image recording apparatus when the size of the recording sheet 5 to be wound on the outer peripheral surface of the rotary drum 13 is to be changed from that shown in FIG. 22 will be described in detail with reference to FIGS. 23 to 26.

Figure 23:
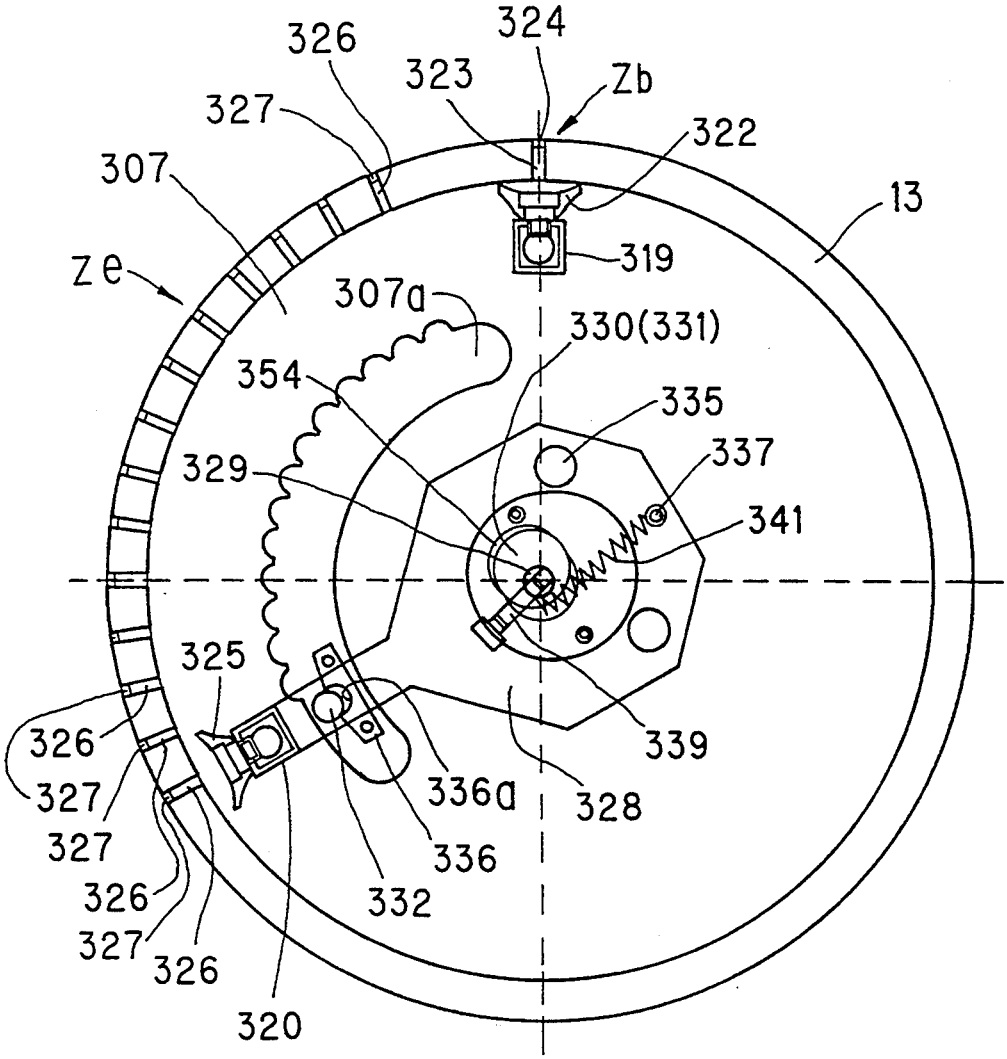
FIGS. 23 through 26 are cross sections for explaining an operation of the holding device of the rotary drum.

The rotary shaft 329 extending along the axis of the rotary drum 13 is rotated from the position shown in FIG. 22 to that shown in FIG. 23 by a rotary drive device (not shown) clockwise direction by 90 degree under control of the controller 11.

That is, with the this rotation of the rotary shaft 329 in FIG. 22, the disc 330 (331) fixed eccentrically to the rotary shaft 329 and engaged with a cam hole 354 formed in the cam plate 333 (334) is rotated by 90 degree.

Therefore, the cam plate 333 and the movable member 328 are moved radially inwardly and hence an engaging member 332 having circular cross section and fixed to the movable member 328 by a screw 357 is separated from a semi-spherical engaging portion c formed on an edge portion of the through hole 307*a* formed in the side end portion 307 of the rotary drum 13 and moved to a receiving groove 336*a* of a stopper 336 fixed to the side plate 303. Thus, the sucking disc 325 which, in FIG. 22, is pressed to the inner wall of the rotary drum 13 is separated from the inner wall as shown in FIG. 23.

Figure 24:
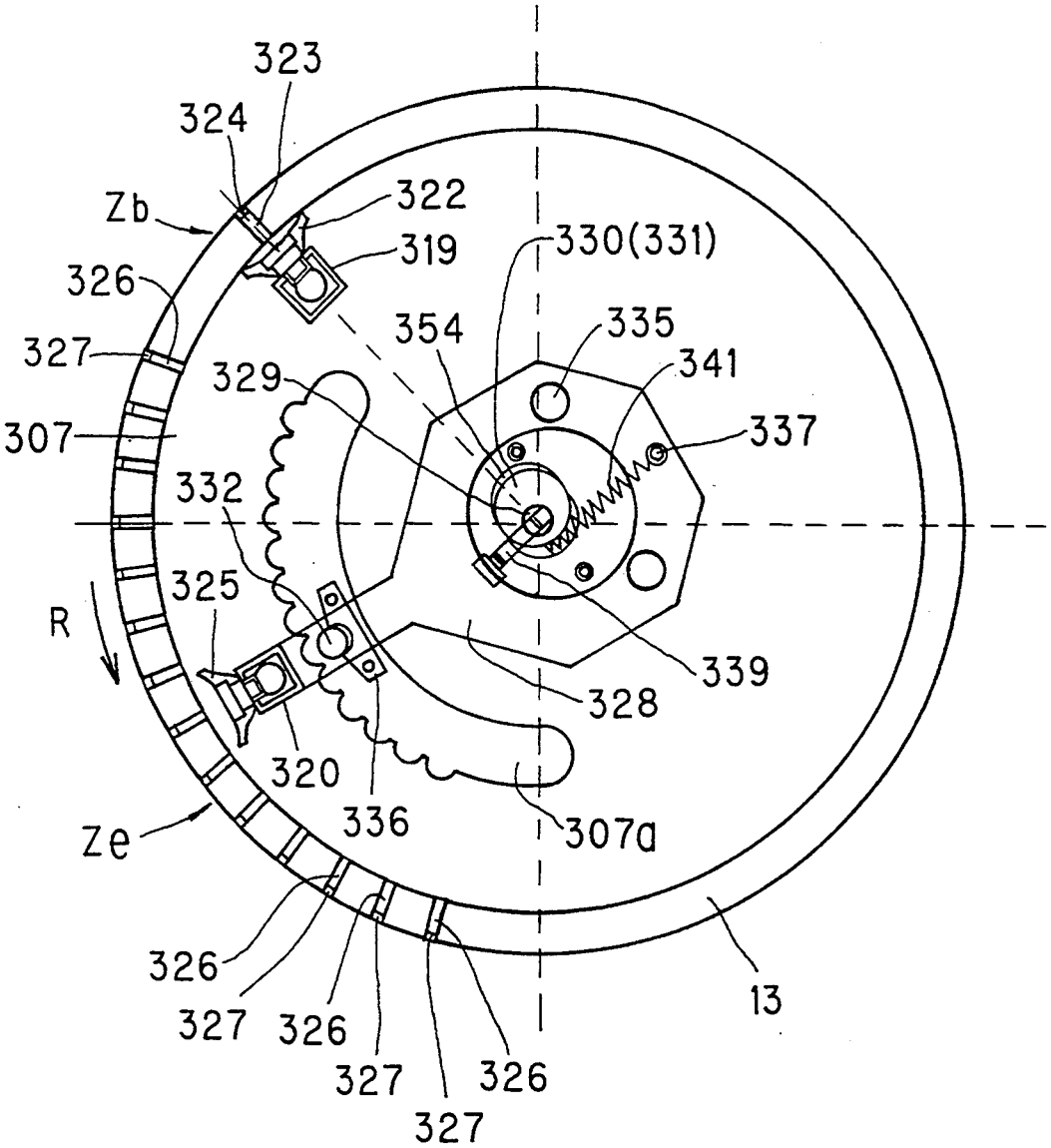

When the rotary drum 13 further rotates in a direction shown by an arrow R as shown in FIG. 24 with the sucking disc 325 being separated from the inner wall, a relative positional relation between the stationary elastic sucking disc 325 and the trailing edge attracting area Ze of the rotary drum 13 is gradually changed since the engaging member 332 fixed to the movable member 328 is received in the receiving groove 336*a* of the stopper 336.

Figure 25:
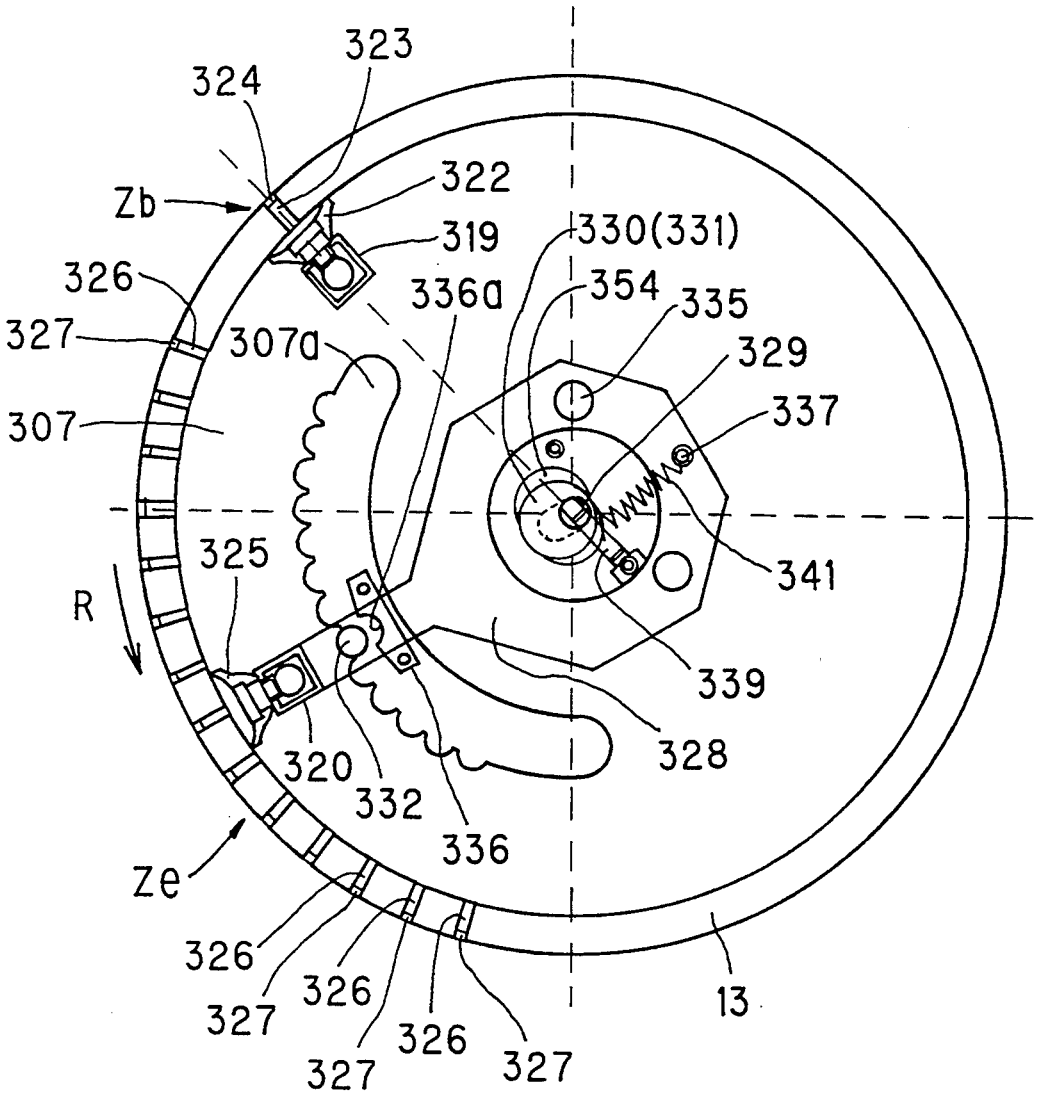
Figure 26:
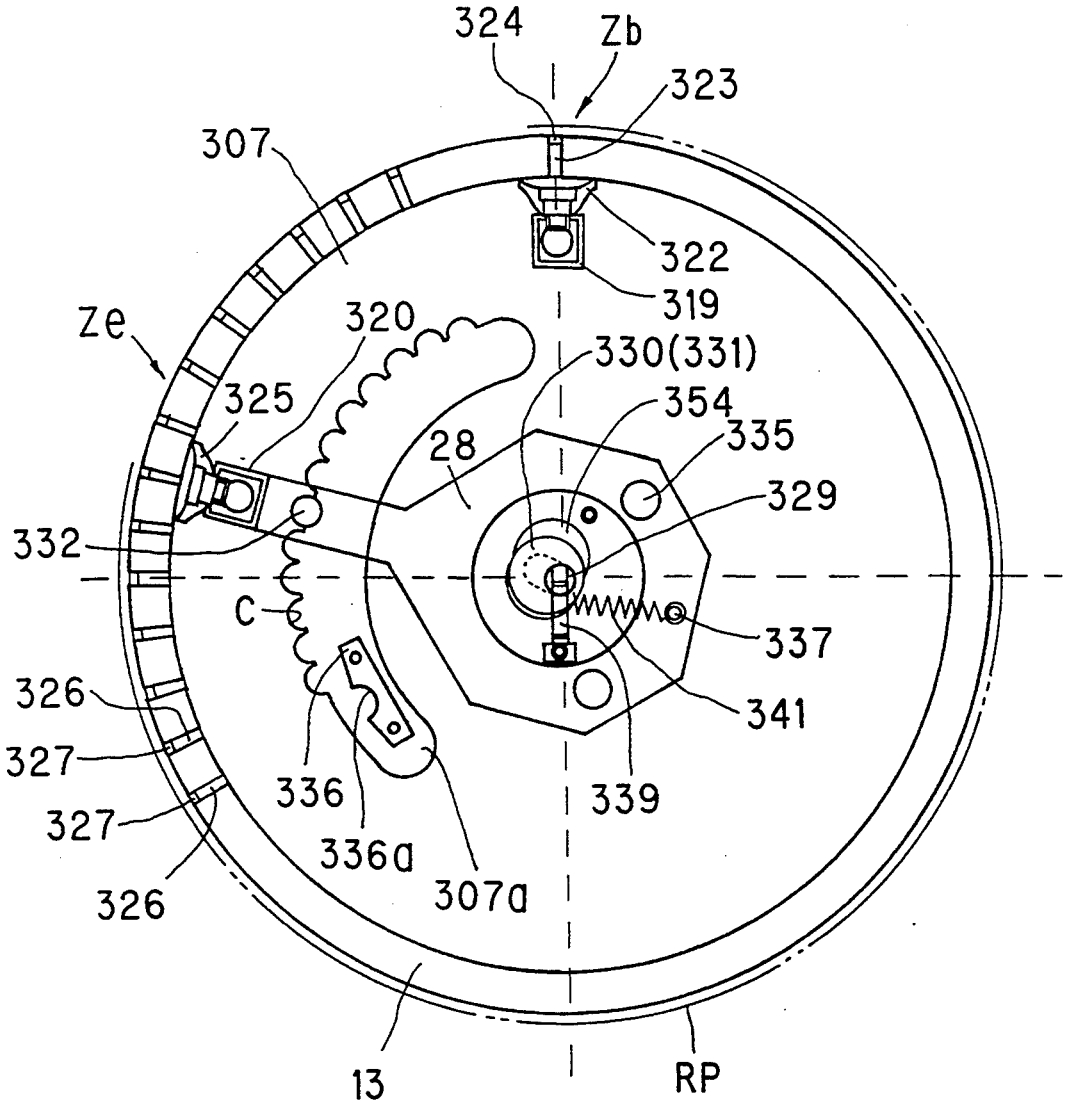

When the elastic sucking disc 325 reaches a predetermined portion of the trailing edge attracting area Ze of the rotary drum 13, the rotary shaft 329 is rotated in counterclockwise direction by 90 degree from the position shown in FIG. 24 to that shown in FIG. 25 by the rotary drive device (not shown) under control of the controller 11.

Therefore, the trailing edge portion of the recording sheet RP is attracted to the trailing edge attracting area Ze due to suction given by the sucking disc 325 through the through-hole 326.

That is, the rotary shaft 329 shown in FIG. 24 is rotated in counterclockwise direction by 90 degree from the state shown in FIG. 24.

Thus, the circular disc 330 (331) fixed eccentrically to the rotary shaft 329 is rotated by 90 degree with the disc 330 (331) being engaged with the cam hole 354 of the cam plate 333 (334).

Therefore, the cam plate 333 and the movable member 328 are moved radially outwardly and hence an engaging member 332 having circular cross section and fixed to the movable member 328 by a screw 357 is separated from the receiving groove 336*a* of a stopper 336 fixed to the side plate 303 and received in another semi-spherical engaging portion c formed on the edge portion of the through-hole 307*a* formed in the side end portion 307 of the rotary drum 13. Thus, the sucking disc 325 is pressed to the inner wall as shown in FIG. 25.

When the operator inputs an information of the size of recording sheet, the sucking disc 325 is pressed to a position in the inner wall of the rotary drum 13 which corresponds to the trailing edge of the recording sheet.

Thereafter, the rotary drum 13 continues to rotate until it reaches the reference rotational phase and stops its rotation thereat.

When the leading edge of the recording sheet RP reaches the leading edge attracting area Zb of the rotary drum 13 and is stopped in the position showing the reference rotational phase after the image recording apparatus starts to operate, a signal is generated by a sensor (not shown) and sent to the controller 11, upon which the controller 11 turns switches SW1 and SW5 shown in FIG. 20(*a*) so that a sucking operation is performed through a sucking port 315 which is connected to the vacuum pump 258 through the tube 259, a directly driven solenoid valve 262 and the tube 264, as shown in FIG. 21.

By the sucking effect due to the sucking port 315, a sucking operation is performed by the through-hole 323 provided in the shallow groove 324 in the leading edge attracting area Zb through the air passage 317 formed in one of the side end portions 306 of the rotary drum 13, the air passage 319 provided in the internal space IS of the rotary drum 13, the inner space of the elastic sucking disc 322 and the through-hole 323, so that the leading edge of the recording sheet RP is attracted to the leading edge attracting area Zb.

Immediately after the leading edge of the recording sheet RP is attracted to the surface of the rotary drum 13, the rotary drum 13 starts to rotate under control of the controller 11 to thereby start the winding operation while the recording sheet RP is attracted to the surface thereof.

Therefore, the recording sheet RP whose leading edge portion is attracted to the surface of the rotary drum 13, the following portion thereof being pressed thereto by the pressure roller 15 is wound on the surface of the rotary drum 13 maintaining the intimate contact therewith.

The signal generated by the sensor (not shown) at a time immediately before the trailing edge of the recording sheet RP is pressed onto the surface of the rotary drum 13 by the pressure roller 15 is given to the controller 11, upon which switches SW3 and SW6 shown in FIG. 20(*b*) are turned on to start a sucking operation of the vacuum pump 269 through the tube 265, the directly driven solenoid valve 268, the tube 269 and the sucking port 316 shown in FIG. 21.

The sucking operation is performed by the suction of the through-hole 326 provided in the shallow groove 327 in the trailing edge attracting area Ze through the air passage 318 formed in one of the side end portions 306 of the rotary drum 13, the air tube 320 provided in the internal space IS of the rotary drum 13, the inner space of the elastic sucking disc 325, the through-hole 326 and the sucking port 316, so that the trailing edge of the recording sheet RP is attracted to the trailing edge attracting area Ze.

Reference numerals 261 in FIG. 20(*a*) and 267 in FIG. 20(*b*) depict vacuum switches which turn on and off according to degree of vacuum in the tubes 259 and 265, respectively.

When the leading edge of the recording sheet RP bearing an image recorded passes through the position of the pressure roller 350, the switch SW1 is turned off and the switches SW2 and SW5 are turned on under control of the controller 11 as shown in FIG. 20(*a*) to stop the sucking operation through the sucking port 315 connected to the vacuum pump 258 through the tube 260, the directly driven solenoid valve 262 and the tube 263.

Therefore, the attracting force given through the through-hole 323 provided in the shallow groove 324 in the leading edge attracting area Zb, the air passage 317 formed in the side end portion 306 of the rotary drum 13, the air passage 319 provided in the internal space IS of the rotary drum 13 and the inner space of the elastic sucking disc 322 is removed, so that the leading edge of the recording sheet RP becomes separable from the leading edge attracting area Zb.

When the leading edge of the recording sheet RP is separated from the leading edge attracting area Zb of the rotary drum 13, the recording sheet RP which is pinched between the pressure roller 15 and the rotary drum 13 is advanced with rotation of the rotary drum 13 and discharged externally by the sheet discharge operation.

To this end, the switch SW3 is turned off and the switches SW4 and SW6 are turned on by the controller 11 to relieve the sucking force given through the vacuum pump 264, the solenoid valve 268, the tube 269 and the sucking port 316.

With the relief of sucking force through the sucking port 316, the the sucking force given through the through-hole 326 in the shallow groove 327 in the trailing edge attracting area Ze, the air passage 318 formed in the side end portion 306 of the rotary drum 13, the air passage 320 provided in the internal space IS of the rotary drum 13 and the inner space of the elastic sucking disc 25 is relieved, so that the trailing edge of the recording sheet RP becomes separable from the trailing edge attracting area Ze.

As mentioned, when the rotary drum 13 holding the electro-photographic recording sheet 5 thereon rotates, the sheet 5 is uniformly charged by the chargers 24 and 25.

The operation timing of the chargers 24 and 25 is determined by the controller 11. For example, the chargers 24 and 25 which may be corottons or scotorons start corona discharge during a second revolution of the rotary drum 13 to charge the sheet 5 held thereon uniformly from its leading edge portion to the leading edge portion.

The chargers 24 and 25 and a corona wire cleaner with its drive source which are not shown are assembled as a unit which can be removed from the apparatus by pulling it out in the similar manner.

Reference numerals 26 and 27 depict a motor and a rotary mirror such as polygonal mirror, respectively. The rotary mirror 27 is driven in a direction shown by an arrow D by the motor 26 at a constant speed to deflect laser beam emitted from a semiconductor laser 28 to a predetermined direction.

The laser beam emitted from the semiconductor laser 28 is intensity-modulated with predetermined exposing data including digital data of a dot matrix image to be recorded.

The laser beam is directed to the uniformly charged electro-photographic recording sheet 5 through an optical system composed of a lens 29, reflection mirrors 30 and 31, etc. The electro-photographic recording sheet 5 is exposed with the predetermined exposing data, resulting in a charge image corresponding to the image information to be recorded on the photo sensitive layer of the sheet 5.

A reference numeral 32 depicts a surface potential meter for measuring surface potential of the electro-photographic recording sheet 5. An output of the surface potential meter 32 is supplied to the controller 11 to set various operating conditions of the image recording apparatus.

A mechanism for pre-bath treatment of the electro-photographic recording sheet 5 is provided at a position between the laser exposing portion and a position just below the rotary drum 13.

The last mentioned mechanism will be described in detail with reference to FIGS. 3 to 9.

Figure 3:
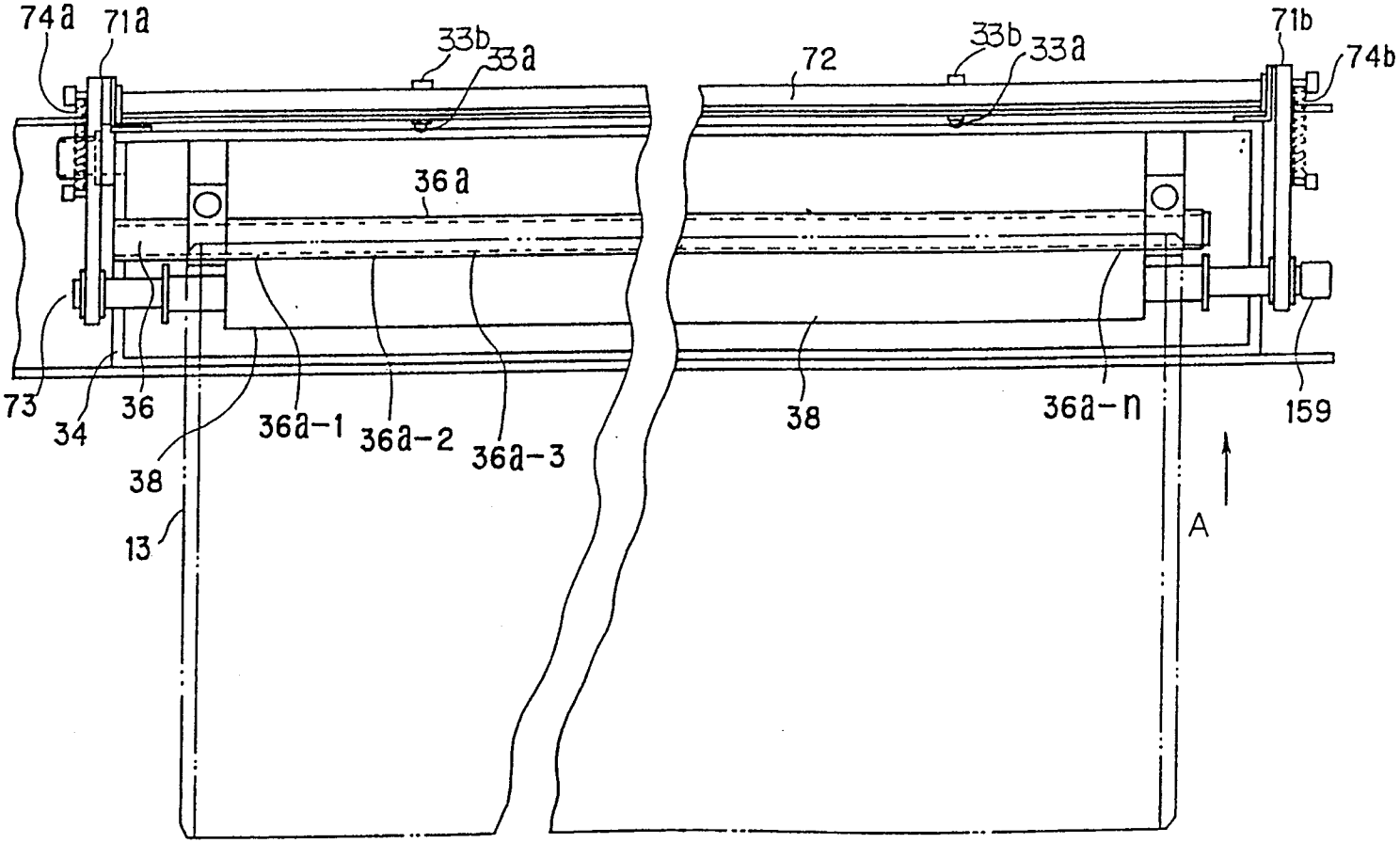
FIG. 3 is a partially cut away plan view of a constructive portion for performing a pre-processing.
Figure 4:
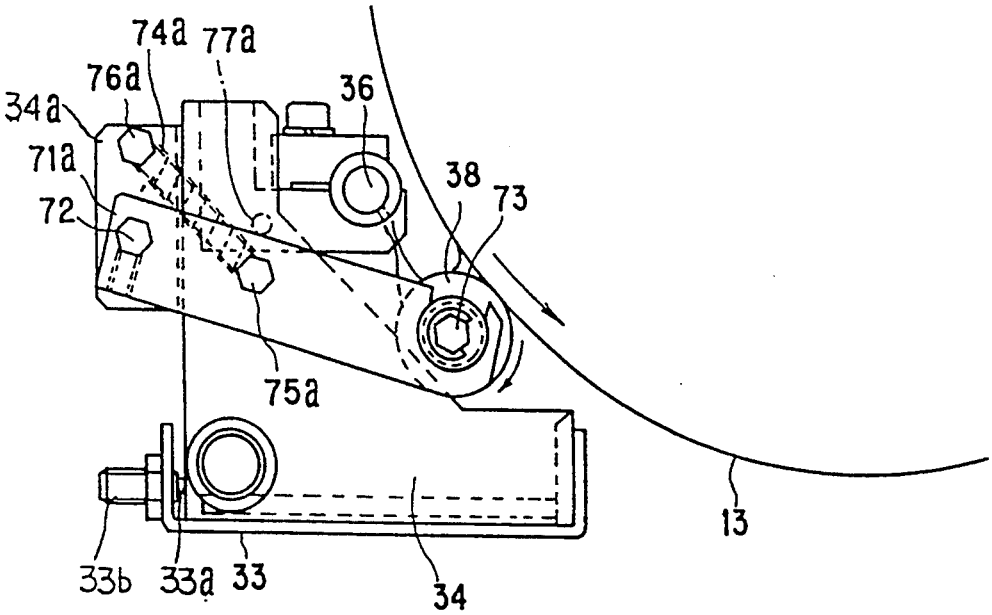
FIG. 4 is a schematic cross section of the portion shown in FIG. 3.
Figure 5:
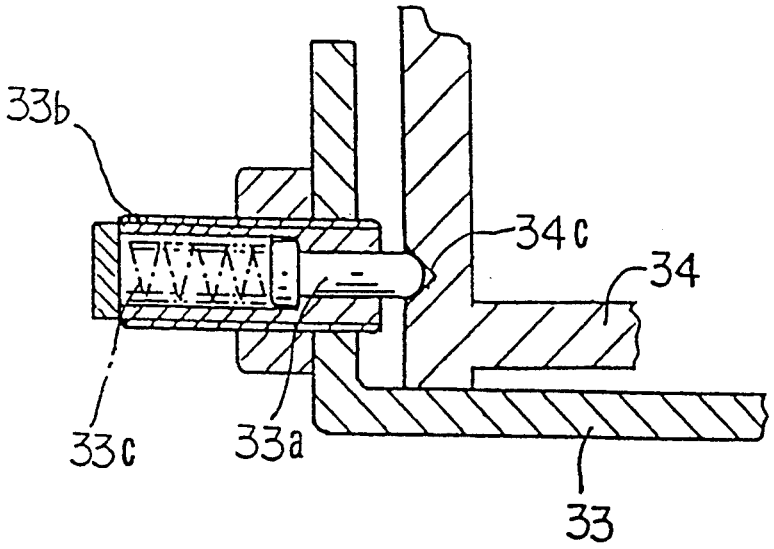
FIG. 5 is a cross section showing a tank 34 in an assembled state.
Figure 6:
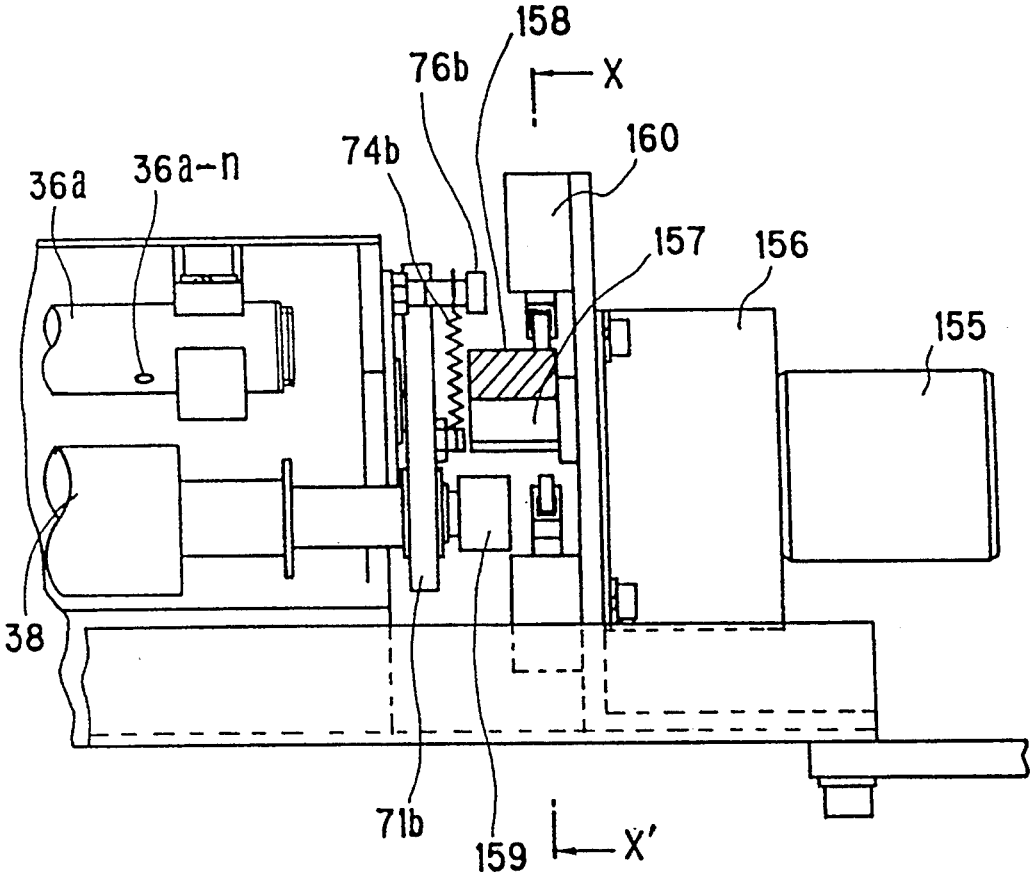
FIG. 6 is a side view of the tank looked in an arrow direction A in FIG. 3.
Figure 7:
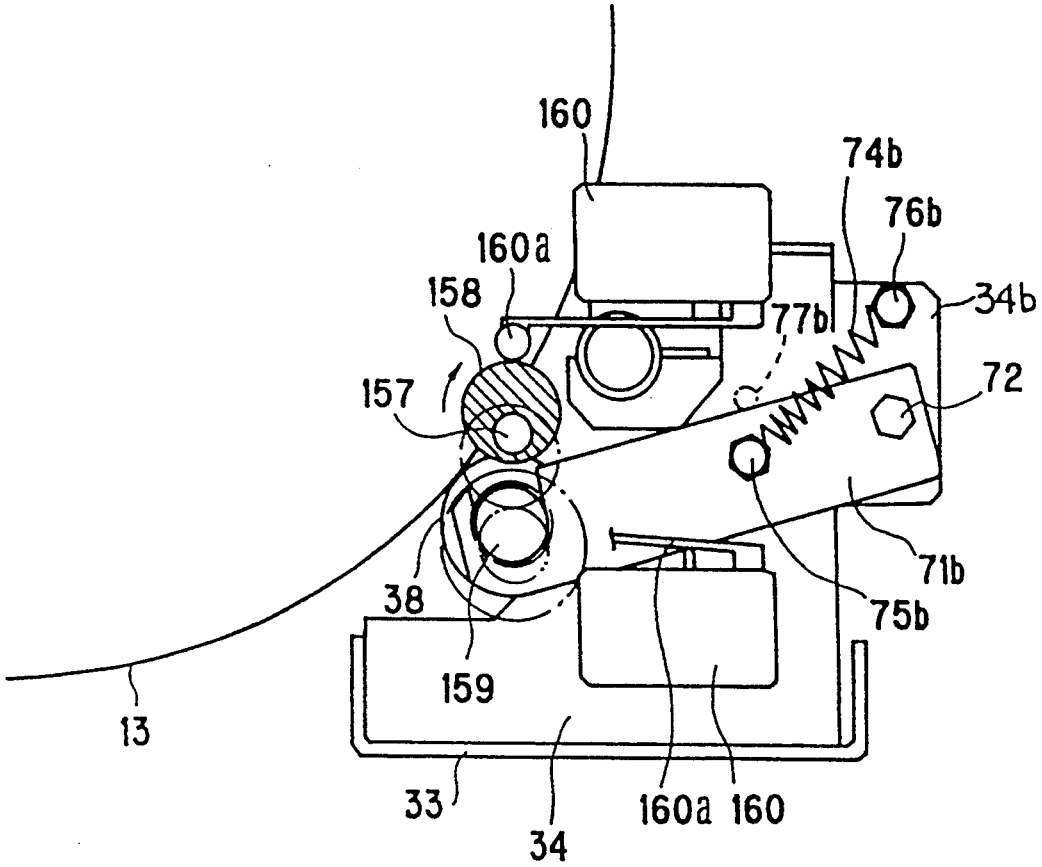
FIG. 7 is a cross section taken along a line X–X' in FIG. 6.
Figure 8:
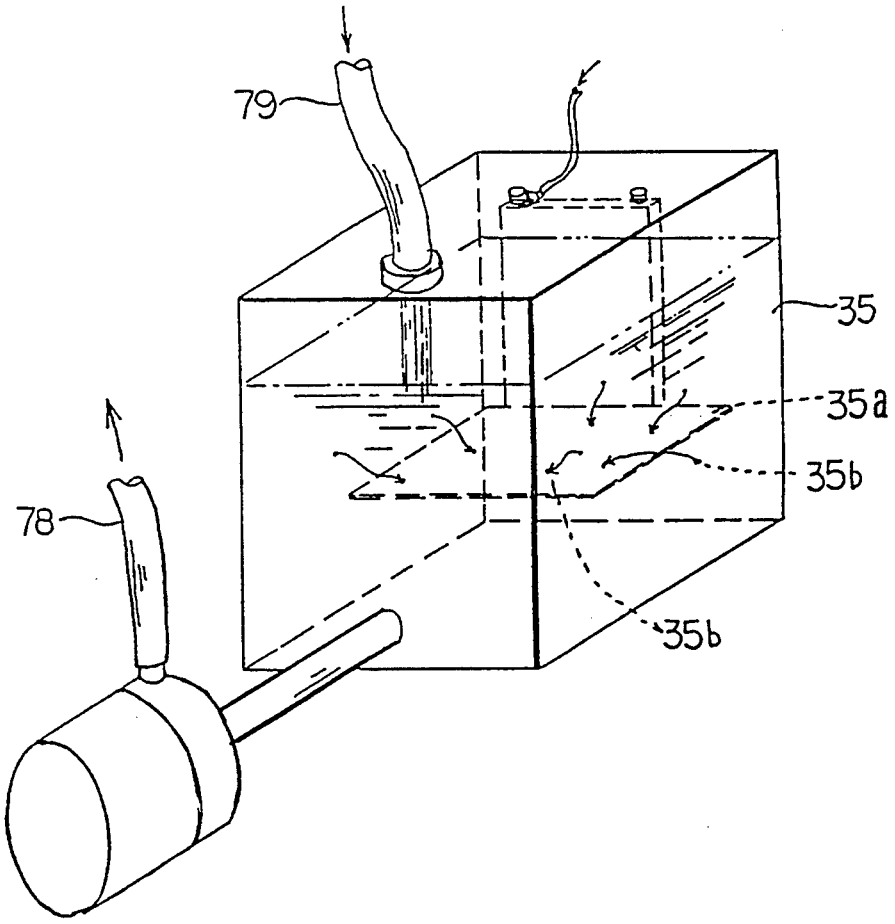
FIG. 8 is a schematic perspective view of a container 35 for pre-processing.
Figure 9:
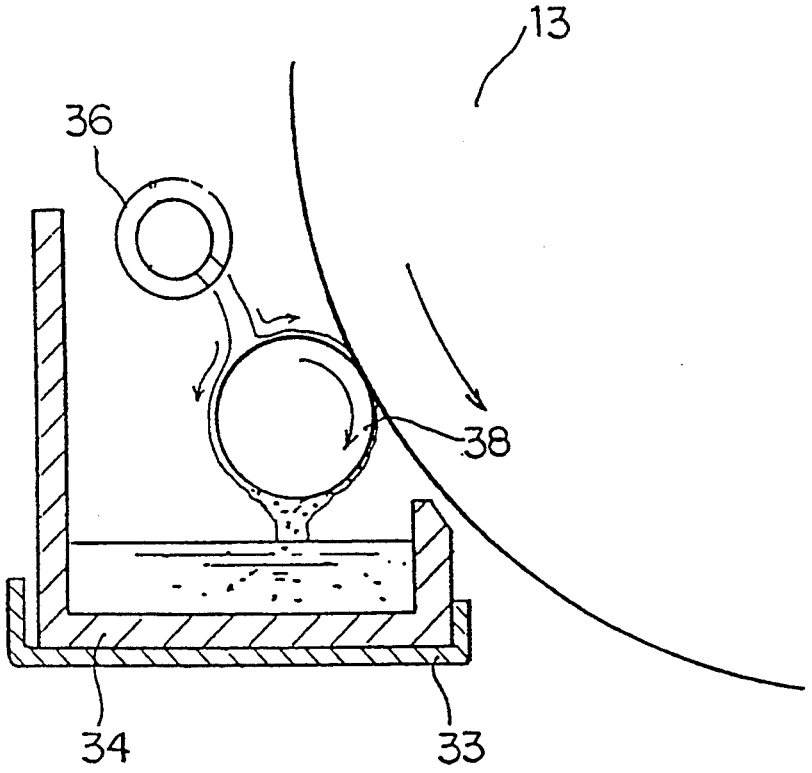
FIG. 9 is a schematic cross section useful to explain the pre-processing in the present image recording apparatus.

FIG. 3 is a plan view of a portion of the mechanism, showing a roller 38 and a tank 34, etc., FIG. 4 is a right side view of the portion, FIG. 5 is a cross section showing a portion of the mechanism for mounting the tank 34, FIG. 6 is a side view of the mechanism looked in a direction of an arrow A, FIG. 7 is a cross section taken along a line X–X' in FIG. 6, FIG. 8 is a schematic perspective view of a container 35 for pre-bath treatment and FIG. 9 illustrates a pre-bath treatment.

In these figures, bath liquid is stored in the container 35 fixedly secured to a base plate 47 of the image recording apparatus and supplied therefrom through a tube 36 and a supply tube 36*a*.

The liquid has a co-solubility with electrically insulating liquid used as a wet type developer and exhibits high insulating characteristics. The liquid is poured to an outer peripheral surface of the roller 38 disposed obliquely below the supply tube 36*a* through a plurality of orifices 36*a*-1, 36*a*-2 . . . 36*a*-*n* formed therein at constant interval.

The electro-photographic recording sheet 5 is painted with the liquid on the roller 38 contacting with the rotary drum 13.

The roller 38 is made of porous elastic material, so that it has a suitable liquid absorbability and its outer periphery can be uniformly in contact with the electro-photographic recording sheet 5.

The longitudinal length of the roller 38 is shorter than a width of the electro-photographic recording sheet 5 so that the liquid is not supplied to undesired side portions of the rotary drum 13.

A shaft 73 of the roller 38 is rotatably supported by levers 71*a* and 71*b* at opposite ends thereof. The levers 71*a* and 71*b* are biased toward the rotary drum 13 by an compression spring 74*a* provided between pins 75*a* and 76*a* and a compression spring 74*b* provided between pins 75*b* and 76*b*, respectively.

In a normal state, the roller 38 is held in a position separated, by an eccentric roller 158 supported by a pin 157, from the rotary drum 13 against the biasing forces exerted thereon by the compression springs 74*a* and 74*b*.

The levers 71*a* and 71*b* are rotatably supported by support plates 34*a* and 34*b* of the tank 34.

The roller 38 is moved toward the rotary drum 13 by means of a drive motor 155 (FIG. 6).

FIGS. 4 and 7 show the roller 38 in a state where it becomes in contact with the rotary drum 13. For example, when an operator selects an operation mode, a motor 155 rotates in a predetermined direction and torque thereof is transmitted through a gear box 156 to the eccentric roller 158 mounted on the support pin 157, with which the eccentric roller 158 is rotated from a position shown by a chain line in which it presses a roller 159 provided on one end of the shaft 73 of the roller 38 against the compression springs 74*a* and 74*b* in an arrow direction to a position in which the pressure contact thereof with the roller 159 is released, as shown in FIG. 7.

Therefore, the roller 38 is moved by the compression springs 74*a* and 74*b*, to the position shown in FIGS. 4 and 7 in which it contacts with the rotary drum 13.

When the eccentric roller 158 is rotated to a position in which it pushes a contact piece 160*a* of a limit switch 160, the motor 155 is stopped.

A limit switch 161 serves to stop the motor 155 when the roller 159 is moved by the eccentric roller 158 away from the rotary drum 13 and its contact piece 161*a* is pushed down thereby.

A time period of the pressure contact of the roller 38 with the rotary drum 13 is controlled by the controller 11 according to an information of length of the electro-photographic recording sheet 5 which is input preliminarily by the operator at the time when he sets the operation mode.

On the other hand, a pulse motor which is not shown is provided in the rotary drum 13 for producing pulse signal in synchronism with rotation of the rotary drum 13. The pulse signal is also supplied to the controller 11.

In the controller 11, the timing of the start of pressure contact of the roller 38 with the rotary drum 13 is preliminarily converted into pulse number. A counter which is not shown counts the pulses and when the counter counts a predetermined number of pulses, it outputs a drive signal to the motor 155 to make the roller 38 in pressure-contact with the rotary drum 13.

A time during which the roller 38 is held in pressure contact with the rotary drum 13 is converted by the controller 11 into pulse number corresponding to the length of the electro-photographic recording sheet 5, so that, when the counter counts the pulses, it outputs the drive signal again to the motor 155 to separate the roller 38 away from the rotary drum 18.

The initial pressure-contact of the roller 38 with the rotary drum 13 is performed at a time when the leading edge of the sheet 5 passes the roller 38 a little bit and the end of the pressure-contact thereof with the rotary drum 13 is performed at a position immediately before the trailing edge of the sheet 5 passes the roller 38.

With such operation timing, pre-bath liquid supplied to the roller 38 can wet only the sheet 5 and excess portion of the liquid to be painted on undesired portions of the drum surface can drop into the tank 34 so that it can be returned to the container 35 through the tube 37.

The container 35 includes an electrolytic deposition plate 35*a* dipped in the pre-bath liquid to absorb excess toner 35*b* mixed therein so that clean pre-bath liquid can be supplied through the tube 78 to the tube 36*a*.

When an amount of the pre-bath liquid to be painted on the electro-photographic recording sheet 5 is too small and thus there may be a risk of foaming thereof, a minute gap of, for example, several tens microns, is provided between the surface of the electro-photographic recording sheet 5 and the roller 38 by means of, for example, stoppers 77*a* and 77*b* engageable with the levers 71*a* and 71*b*, so that thickness of the pre-bath liquid on the electro-photographic recording sheet 5 can be controlled to increase the thickness.

According to the pre-treatment in this embodiment, the pre-bath liquid is first dropped onto the roller 38 and the electro-photographic recording sheet 5 is painted with the pre-bath liquid by means of the roller 38.

Therefore, according to the present invention, the removing process of undesired material such as toner particles mixed in the circulating pre-bath liquid is included to always supply fresh pre-bath liquid.

For easiness of maintenance of the tank 34 and the roller 38, they are assembled as a block which can be derived along support rails 33 from the image recording apparatus as shown in FIG. 7.

As shown in FIGS. 3 to 5, the tank 34 is held in its normal position by a resilient engagement of a spherical top end of a pin 33*a* provided on the support rail 33 and biased to the tank 34 by a spring 33*c* provided with a mounting portion 33*b* with a recess 34*c* formed in a rear side of the tank 34.

Therefore, the tank 34 is easily derived, together with the roller 38, from the image recording apparatus smoothly.

The electro-photographic recording sheet 5 which is pre-bath processed is developed by a developing portion.

Developing electrodes of the developing portion are provided below the rotary drum 13 in a position in an upstream side of a lowest point of the drum 13.

Although only developing electrode 56*a* is shown, there are developing electrodes 52*a* to 56*a* provided on selectively operable developing devices 52 to 56, respectively. That is, in the shown state, the developing device 56 is selected. In any way, all major portions of the developing electrodes 52*a* to 56*a* are arranged as mentioned.

A surface of one, for example, of the developing electrodes 52*a* to 56*a* of the developing devices 52 to 56 is faced to the surface of the electro-photographic recording sheet 5 wound intimately on the rotary drum 13 with a slight gap therebetween.

Electro-photographic developer of wet type is supplied from one of containers 42 to 46 arranged on the base plate 47 of the image recording apparatus and corresponding to the selected developing device through a tube 85 and through-holes formed in the surface of the developing electrodes 56*a* onto the surface of the electro-photographic recording sheet 5 on the rotary drum 13. Toner whose amount corresponds to an amount of electric charge of a charge image on the sheet 5 is supplied to the surface of the sheet 5, resulting in a visible charge image.

The rear surface 56*e* of the developing electrode 56*a* is inclined correspondingly to inclination of the surface of the electro-photographic recording sheet 5 wound intimately on the rotary drum 13. Therefore, electro-photographic wet developer flown out from the through-holes of the developing electrode 56*a* flows smoothly along the rotational direction of the rotary drum 13 while filling the gap between the surface of the developing electrode 56*a* and the surface of the electro-photographing recording sheet 5 and then recovered in the developing device 56.

Developer recovered in the developing device 56 is returned to the container 46 through the tube 90.

In FIG. 1, the developer containers 42 to 46 arranged on the base plate 47 of the image recording apparatus store different developers. Each developer is a mixture of an electrically insulating liquid and developing particles dispersed therein. Developing particle contains specific coloring agent and binder, etc.

In this embodiment, the developer container 42 contains wet type electro-photographic developer which is lipophilic and is used to obtain a recorded electro-photographic recording sheet to be used as a planographic plate.

The developer containers 43 to 46 contain wet type developers for respective colors (yellow, magenta, cyan, black) to be used to obtain recorded electro-photographic recording sheet for proof.

As mentioned, the different wet type developers contained in the containers 42 to 46 are supplied through tubes 81 to 85 to the respective developing devices 52 to 56, respectively. From the respective developing devices 52 to 56, excess developers are returned through tubes 86 to 90 to the containers 42 to 46, respectively.

Among the developing devices 52 to 56 mentioned above, a selected one is arranged such that at least a major portion of the developing electrode thereof is positioned below the rotary drum 13 and in an upstream side thereof. In this embodiment, the developing devices 52 to 56 are provided on a pair of transportation belts of chains extended in parallel to each other with a predetermined distance. Mutual distances between the developing devices 52 to 56 on the transportation belts are regulated by space regulators 91 to 96, respectively. Therefore, by lifting a selected one of the developing devices by means of a lift device provided between the belts while moving the transportation belts in a direction shown by an arrow E, the selected developing device can be used for developing purpose. On the other hand, by lowering the lifted developing device onto the transportation belts and lifting another developing device, any one of the developing devices can be used selectively. An arrow F in the figures shows moving directions of the lifting device.

The respective developing devices 52 to 56 can be pulled from the recording apparatus along the spacers as guides for maintenance purpose.

In FIG. 1, each transportation belt 50 is extended between a driving sprocket 48 and a driven sprocket 49. The sprockets 48 are mounted on a common shaft and driven under control of the controller 11. Also the driven sprockets 49 are mounted on a common shaft. In order to prevent slackening and/or meandering of the transportation belts, guide plates 51 are provided. It should be noted that FIG. 1 shows only the transportation belt 50, the sprockets 48 and 49 associated therewith and the guide plate 51 also associated therewith arranged behind.

Figure 2:
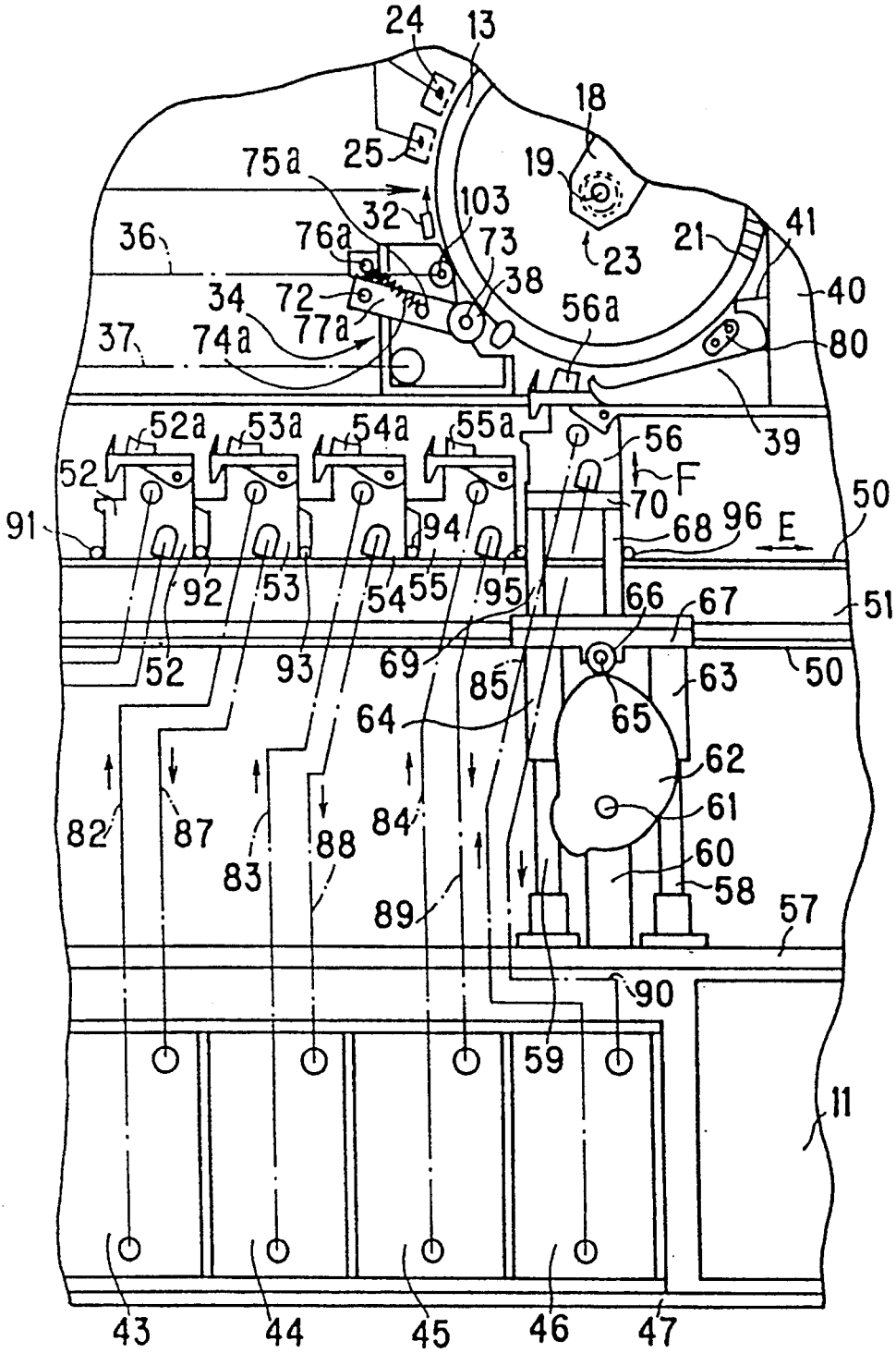
FIG. 2 is an enlarged side view of a portion of the image recording apparatus shown in FIG. 1.

As to the space regulators 91 to 96 shown in FIG. 2, they are fixedly arranged across the paired transportation belts 50 and regulate positions of bottom plates of the developing devices 52 to 56, respectively.

The controller 11 controls driving force to be transmitted to the driving sprockets 48 to move any selected one of the developing devices 52 to 56 to a position of the lift device.

The lift device comprises a cam plate 62 fixedly mounted on a cam shaft 61 implanted on a support 60, so that the cam plate 62 is rotated by the cam shaft 61 whose rotation is controlled by the controller 11. The lift device further comprises a cam follower in the form of a roller 66 which is rotatably supported by a shaft 65 and slidable along a cam surface of the cam plate 62. The shaft 65 is fixedly supported by a base plate 67 so that the latter can be moved vertically by rotation of the cam plate 62.

Vertical guide portions 63 and 64 are fixedly secured to a lower portion of the base plate 67 of the lift device. The vertical guide portions 63 and 64 have holes are guided vertically by vertical guide rods 58 and 59 fixed to the mounting plate 57 and received in the holes, respectively. Further a support plate 70 is provided on the base plate 67 through connecting stands 68 and 69.

The support plate 70 of the lift device is lifted up with rotation of the cam plate 62 from a position thereof below the belts 50 on which the developing devices 52 to 56 are mounted. With this upward movement of the support plate 70, one of the developing devices which is selected is lifted up to the position shown in FIGS. 1 and 2 and performs the developing operation mentioned previously.

The developing device whose developing operation is completed is moved down onto the belts 50 with downward movement of the support plate 70 caused by further rotation of the cam plate 62 under control of the controller 11.

The developing devices 52 to 56 are selected and used for developing operation in this manner, respectively.

The electro-photographic recording sheet 5 developed in the developing portion and carrying excess developer which could not drop in the developing electrode portion is moved by the rotary drum 13. Since, in the present image recording apparatus, the developing electrodes are arranged on upstream side of the area immediately below the rotary drum 13, there is an enough distance provided to drop such excess developer carried on the recording sheet and return to the developing device.

Depending upon viscosity of wet type developer, some portion of such excess developer on the surface of the electro-photographic recording sheet may be carried to the fixing portion along with rotation of the rotary drum 13. In such case, fogging and/or uneven development may occur. Therefore, in order to prevent such fogging and/or uneven developing from occurring, excess developer has not to be carried up to the fixing portion.

In the present image recording apparatus, an excess developer removing portion capable of removing excess developer by air-pressure is provided in a position on a downstream side of the area immediately below the rotary drum 13 and in the vicinity of the developing electrodes provided in the developing portion.

In the excess developer removing portion, a blower room 40 having, for example, a sirocco fan is provided as shown in FIG. 1. Air from the blower room 40 is guided through a conduit 39 and blows to the rotary drum 13 at a position close to the developing electrodes of the developing portion, so that excess developer carried on the recording sheet 5 with rotation of the rotary drum 13 which is otherwise carried into the fixing portion is collected in the area immediately below the rotary drum 13 to facilitate dropping thereof.

The excess developer removing portion will be described in more detail with reference to FIGS. 10 to 12.

Figure 10:
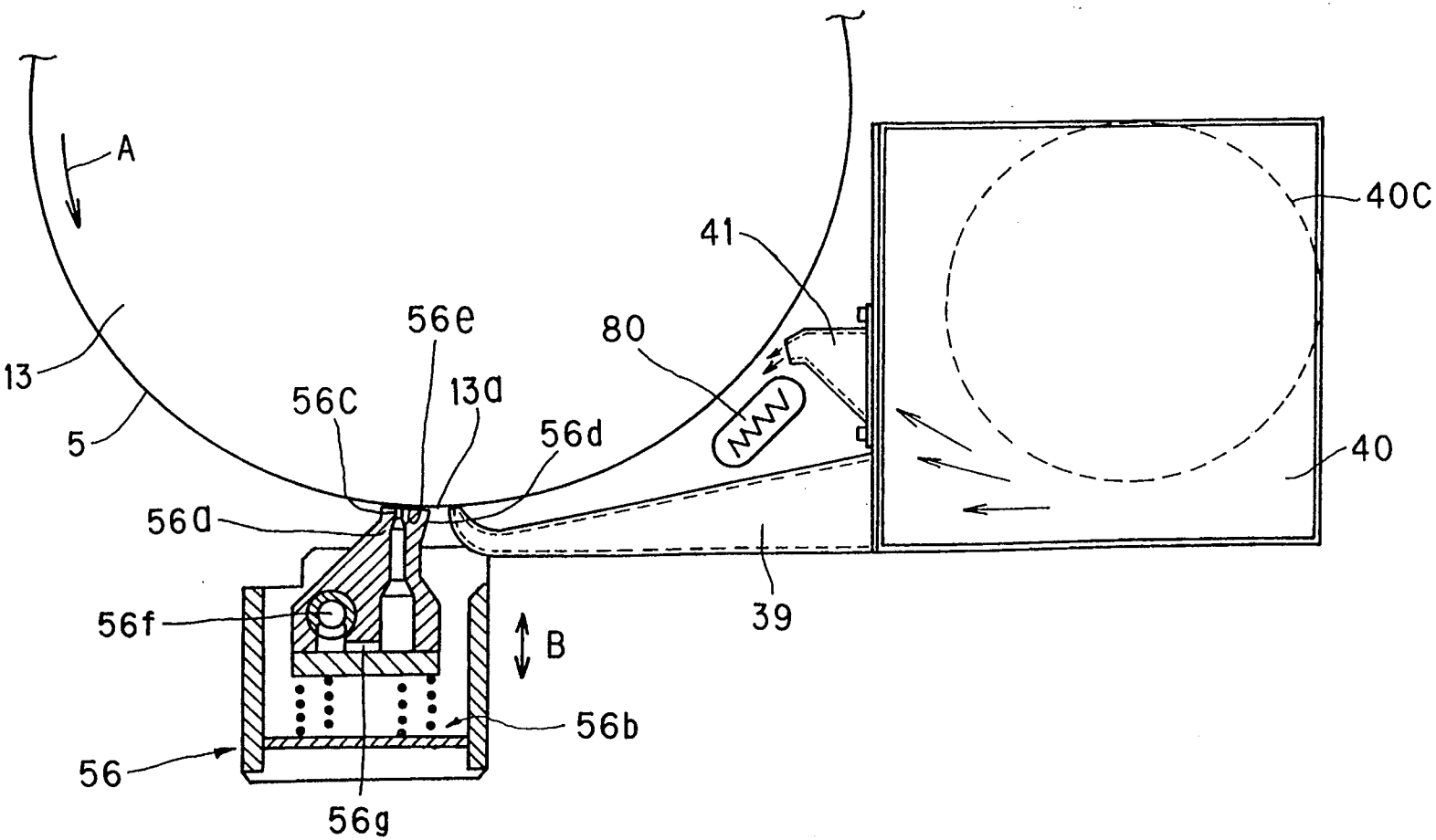
FIG. 10 is a partially cross sectioned side view showing a construction around an excess developer removing device according to an embodiment of the present invention.

FIG. 10 shows the excess developer removing portion shown in FIG. 1 in an enlarged scale. In FIG. 10, the developing device 56 is constructed mainly with the developing electrode **56*a* extending in parallel to the axis of the rotary drum 13 to cover an area of the surface of the rotary drum 13 whose axial length is slightly smaller than the axial length of the rotary drum 13 and a developer drain 55*b* for recovering developer overflown from the developing electrode 56*a***.

In a developing state, a predetermined gap is provided between the surface of the rotary drum 13 and a face **56*e* of the developing electrode 56*a*** opposing thereto.

Further, at least a major portion of the opposing face **56*e* of the developing electrode 56*a* is positioned on the upstream side of the area below the lowest point 13*a* of the rotary drum 13**.

Further, in the developing state, a tangential plane passing through the lowest point **13*a* makes an acute angle with respect to a side surface 56*d* of the developing electrode 56*a* on the downstream side of the rotary drum 13**.

Therefore, air blown from the nozzle 39 flows along the side surface **56*d*** for reasons to be described.

The electro-photographic developer of wet type supplied from the container 46 is supplied to a developer supply port **56*f*, past through a developer supply path 56*g* provided within the developing electrode 56*a* to a developer exit port 56*c*** in communication with the gap and discharged therefrom to fill the gap.

A major portion of the developer over-flown from the gap is guided along the side surface **56*d* of the developing electrode 56*a* and flows down to the drain 56*b***.

The developer flown into the drain **55*b* is collected in the container 46 through the tube 90** for reuse.

The blower room 40 includes, mainly, a blower **40*c* for supply air while accelerating it and an air conduit or nozzle 41 in addition to the nozzle 39. The nozzles 39 and 40 extend in parallel to the axis of the rotary drum 13 to cover areas of the surface of the rotary drum 13 whose axial length are slightly smaller than the axial length of the rotary drum 13**.

The gap defined between the opposing face **56*e* of the developing electrode 56*a* and the surface of the rotary drum 13 is filled with the developer supplied thereto continuously as mentioned previously. Thus, the electrostatic latent image on the electro-photographic recording sheet 5** is developed, resulting in a visible image.

The electro-photographic recording sheet 5 bearing the developed image is separated from the opposing surface 56*e* of the developing electrode 56*a* with rotation of the rotary drum 13 and passes the side surface 56*d* of the developing electrode 56*a*.

After passed through the side surface 56*d*, the residual developer on the electro-photographic recording sheet 5 is forced back to the side of the side surface 56*d* by air flow given by the nozzle 39 of the blower 40*c* and flows down together with the air flow along the side surface 56*d*. The residual developer flown down along the side surface 56*d* is collected in the developer recovery drain 56*b*.

The electro-photographic recording sheet 5 whose residual developer is removed in this way is further moved to a heat-fixing portion 80 with rotation of the rotary drum 13 and heated thereby. Air flow produced by the blower 40*c* and branched to the nozzle 41 from which it is directed to the electro-photographic recording sheet 5 in the heat-fixing portion 80. Thus, the visible image on the sheet 5 is fixed by heat generated by the heat fixing portion and dried by air flow from the nozzle 41.

As mentioned, since heat by the heat fixing portion 80 and air flow from the nozzle 41 are simultaneously supplied to the sheet 5, the fixing process becomes reliable. Further, since air flow is obtained by branching air flow generated by the blower 40*c*, there is no need of providing any blower therefor separately, making the miniaturization of apparatus possible.

A positional relationship between the developing electrode 56*a* and the nozzle 39 and a configuration of the developing electrode 56*a* which are important features of the present invention will be described with reference to FIGS. 11 and 12.

Figure 11A:
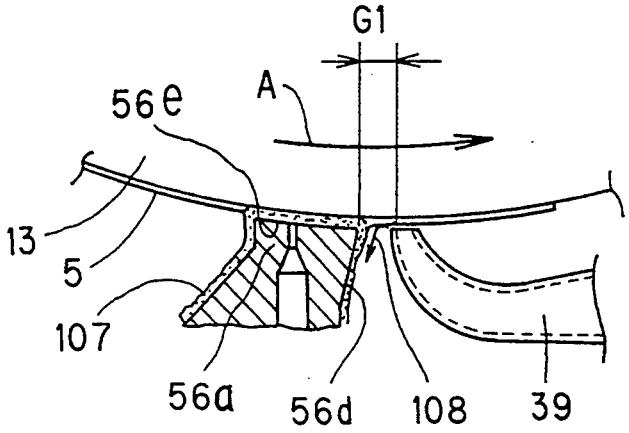
FIG. 11(A) shows the positional relation between the developing electrode and the nozzle.

FIG. 11(A) shows the positional relation between the developing electrode 56 and the nozzle 39. It is clear that the nozzle 39 is provided in the downstream side of the developing electrode 56*a*.

In this case, a maximum allowable value of distance G1 between the side surface 56*d* of the developing electrode 56*a* and the nozzle 39 depends upon characteristics of the electro-photographic recording sheet 5, characteristic of the wet type developer and rotational speed of the rotary drum 13, etc. Therefore, the distance G1 should be determined by taking these parameters into consideration such that there is no accumulation of developer in the area between the developing electrode 56*a* and the nozzle 39 and there is no developer invasion into the nozzle.

According to experiments conducted by the inventors, it was confirmed that, when the distance G1 is set to a suitable value less than the above mentioned maximum value as shown in FIG. 11(A), there is no developer accumulation between the developing electrode 56*a* and the nozzle 39 and almost all of the excess developer flows down along the side surface 56*d* of the developing electrode 56.

Figure 12A:
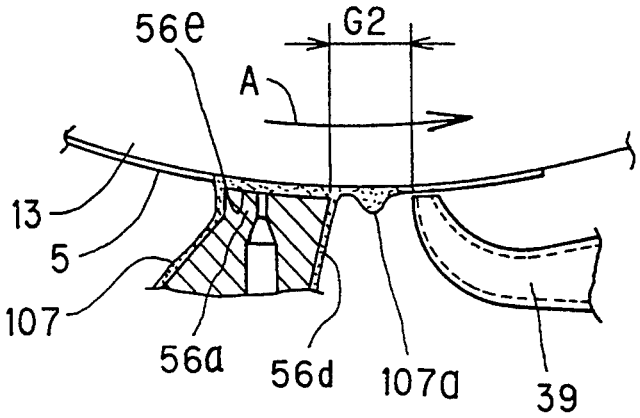
FIG. 12(A) shows the position relation between the developing electrode and the nozzle.

On the contrary, when the distance between the developing electrode 56*a* and the nozzle 39 is set to G2 which is larger than the maximum value as shown in FIG. 12(A), developer accumulates in the area therebetween as shown by 107*a*. This phenomenon may occur for the following reason. That is, since the distance G2 is very large, developer 107 on the sheet 5 is not subjected to air flow from the nozzle 39 immediately after it passes the side surface 56*d* of the developing electrode 56*a* and carried toward the nozzle 39 along rotation of the rotary drum 13 in the direction A. The developer 107 thus carried encounters developer forced back by air flow from the nozzle 39, resulting in the accumulation 107*a*.

In the case shown in FIG. 12(A), when the whole opposing surface 56*e* of the developing electrode 56*a* is arranged in the upstream side of the lowest point 13*a* of the rotary drum 13, the developer 107 may be subjected to force in the direction of the arrow A caused by gravity.

In the case shown in FIG. 11(A), however, pressure of air flow from the nozzle 39 may be applied directly to the trailing edge of the opposing surface 56*e* of the developing electrode 56*a* due to the fact that G1 is short. Therefore, the developer 107 on the recording sheet 5 is not carried toward the nozzle 39 and may be removed from the sheet immediately after it passes the side surface 56*d* and flow down along the side surface 56*d*.

Since the tangential plane at the lowest point 13*a* of the rotary drum 13 makes an obtuse angle to the side surface 56*d* of the developing electrode 56*a*, air from the nozzle 39 flows down together with the developer 107 along the side surface 56*d* without substantial turbulence thereof, as shown by 108.

Figure 11B:
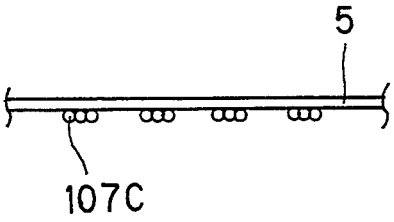
FIG. 11(B) is a cross sectional view of the electro-photographic recording sheet taken along the axial direction of the rotary drum.
Figure 11C:
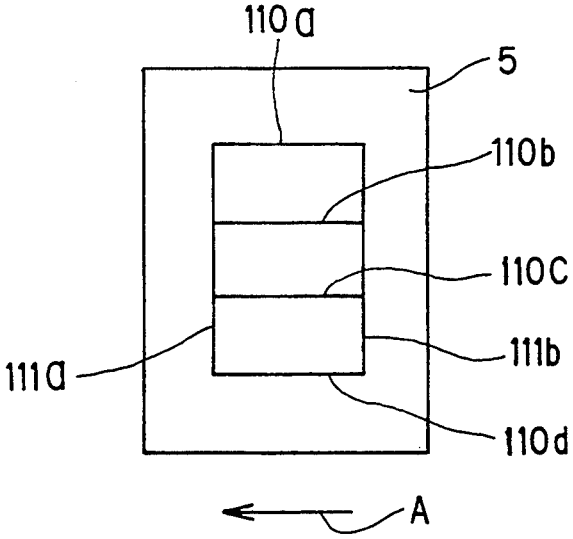
FIG. 11(C) is a plan view of the electro-photographic recording sheet on which a pattern composed of a plurality of lines is depicted.

The case shown in FIG. 11(A) will be compared with the case shown in FIG. 12(A), when applied to a developing process for developing a pattern composed of four line segments 110*a* to 110*d* which are in parallel to the rotational direction A of the rotary drum 13 and two line segments 111*a* and 111*b* which are orthogonal to the line segments 110*a* to 110*d* as shown in FIG. 11(C).

Figure 12B:
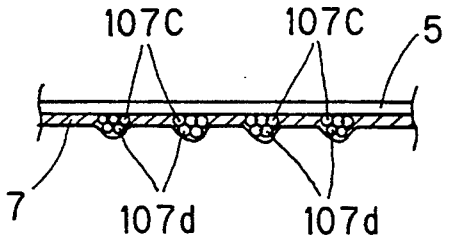
FIG. 12(B) is a cross sectional view of the electro-photographic recording sheet taken along the axial direction of the rotary drum.
Figure 12C:
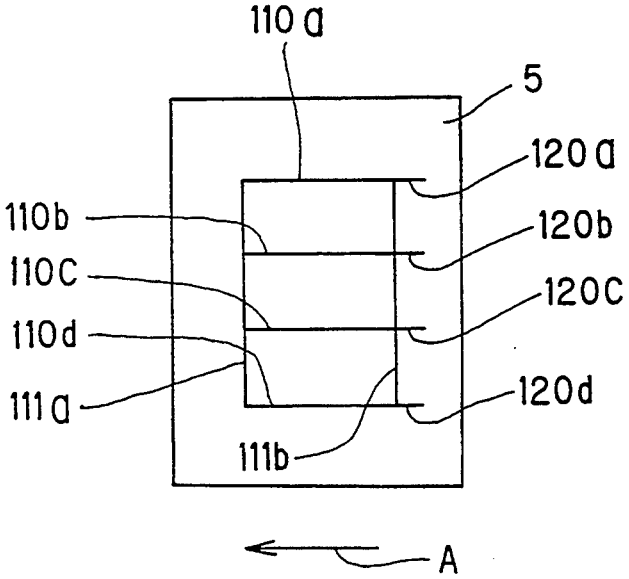
FIG. 12(C) is a plan view of the electro-photographic recording sheet on which a pattern composed of a plurality of lines is depicted.

FIG. 11(B) is a cross section of the electro-photographic recording sheet 5 taken along the axial direction of the rotary drum 13 at a substantially center point of the distance G1 between the developing electrode 56 and the nozzle 39 in FIG. 11(A), showing toner particles 107*c* on the sheet 5 to be developed, and FIG. 12(B) is a cross section of the electro-photographic recording sheet 5 taken along the axial direction of the rotary drum 13 at a substantially center point of the distance G2 between the developing electrode 56*a* and the nozzle 39 in FIG. 12(A), showing toner particles 107*c* and excess toner particles 107*d* on the sheet 5 to be developed.

The accumulated developer 107*a* in the case shown in FIG. 12(A) is not subjected to the biasing voltage applied to the developing electrode 56*a*. Therefore, the excess developer, that is, toner particles 107*d* are collected in the line segments 110*a* to 110*d* which form a contour of the pattern by electrophoresis. The excess toner particles 107*d* move in the opposite direction to the rotating direction A of the rotary drum 13, causing the so-called "streaks" 120*a* to 120*d* to be produced in a non-image portion, that is, on the right side of the line segment 111*b* in FIG. 12(C).

In the case shown in FIG. 11(A), there is no accumulation of excess developer as shown in FIG. 11(B). That is, since excess toner flows down along the side surface 56*d* of the developing electrode 56*a* substantially completely, only toner particles 107*c* to be used to develop the image are left on the recording sheet 5. Therefore, there is no "streaks" in the non-image portion.

As mentioned, with a correct setting of the distance between the nozzle 39 and the side surface 56*d* of the developing electrode 56*a*, excess developer can be removed without distortion of toner image, resulting in a high quality image having no streak and no developing mark. Further, foaming, scattering and evaporation of developer, etc., can be minimized.

Further, since the heat fixing portion is supplied with branched air flow, the performance of the heat fixing portion is improved without providing any separate air supply means, making miniaturization of the image recording apparatus possible.

As mentioned previously, the toner image corresponding to the charge image is formed on the electrophotographic recording sheet 5 by developing. Then, excess toner is removed by the excess developer removing portion and is fixed by heating and drying process in the thermal fixing portion 80. Thereafter, residual potential of the electro-photographic recording sheet 5 is removed by the discharging portion 102 composed of, for example, a lamp, resulting in a recorded electrophotographic recording sheet 5.

In the case of a single color image recording, the leading edge of the recorded electro-photographic recording sheet 5 is separated from the surface of the rotary drum 13 by the vacuum pump controlled by the controller 11 in such a way that, when the leading edge of the recorded electro-photographic recording sheet 5 rotating together with the rotary drum reaches the upper extreme position of the rotary drum 13, air is jetted from the suction ports 17 of the suction device, while the trailing edge portion of the recorded sheet 5 whose leading edge portion is separated from the surface of the rotary drum 13 is still held in intimate contact with the surface of the rotary drum 13 by the effect of the suction hole 20.

The leading edge portion of the recorded sheet 5 is guided onto a base plate 101 of a discharge portion and then moves along the base plate 101. Then, it is pinched between rotating discharge rollers 99 and 100 and discharged externally of the image recording apparatus.

The sheet discharge rollers 99 and 100 and driving sources associated therewith are constructed as a block and detachably mounted on an upper portion of the apparatus.

Alternatively, it is possible to detachably mount only the sheet discharge roller 100.

Since the apparatus is controlled by the controller 11 such that, when the trailing edge portion of the recorded sheet 5 reaches the upper extreme of the rotary drum 13, air is jetted from the suction port 20, the trailing edge of the recorded sheet 5 is separated from the surface of the rotary drum 13 and discharged. Then, the rotary drum 13 is stopped in the initial rotation phase under control of the controller.

In a case where the recorded sheet 5 obtained by the single color image recording operation is a planograph and development is performed by using lipophilic wet developer, the thermal fixing is performed by high power thermal fixing devices 97 and 98 disposed in between the sheet discharging process, so that there is no need of providing a post thermal fixing step for the sheet discharged from the apparatus.

Alternatively, the thermal fixing devices 97 and 98 may be removed. In such case, the thermal fixing device 80 is constructed such that its output can be switched between high and low. That is, in obtaining a recorded sheet 5 for proof, a heating and drying fixing is performed by using the low output and, in obtaining a planograph, a high power thermal fixing is performed by using the high output.

In a case where the image recording is a multi-color recording, the aforementioned process from the electrically charging step to the discharging step is repeated for individual colors without discharging the sheet after the electrical discharging step until the electrical discharging step for the last color image is completed.

In the multi-color image recording, it is preferable that, after all of the steps necessary for each color image recording are completed, the initial rotational phase of the rotary drum 13 is set to the reference rotational phase position for the process of a next color image recording.

It is preferable to provide a mechanism capable of cleaning the rotary drum 13 after all image recordings are completed. With such mechanism, it is possible to prevent degradation of the performance of the rotary drum 13 in attracting the electro-photographic recording sheet 5 and mixing of recording colors, etc. When the sheet supply roller portion, the cutting portion, the leading edge limiter, the electric charger, the pre-bath treatment portion, the developing device and the sheet discharging portion are constructed as individually detachable blocks as mentioned previously, the assembling operation of the image recording apparatus is facilitated and testing of the respective blocks is also facilitated. Therefore, the maintenance of the image recording apparatus is easy, resulting in high serviciability.

A cleaner for cleaning the wet type developing portion of the image recording apparatus according to the present invention will be described.

After tile developing operation is completed, the wet type developing portion is shifted from the position in which the developing operation is performed with respect to the recording sheet to a predetermined home position.

In the home position, reciprocally slidable elastic blades are provided correspondingly to surfaces of the developing electrodes, a surface of the excess developer removing member, etc., which are to be cleaned, to wipe these surfaces.

The surfaces of developing electrodes 52*a* to 56*a* of the wet type developing devices 52 to 56 moved to the predetermined home position are cleaned by the cleaner provided in the home position and the blade 473 used to remove excess developer is also cleaned. The cleaner is shown in side view in FIG. 27 and in front view in FIG. 28. The wet type developing device 56 (or any of 52 to 55) shown by an imaginary line in FIG. 27 is in the position in which the lifting operation therefor is performed.

Figure 27:
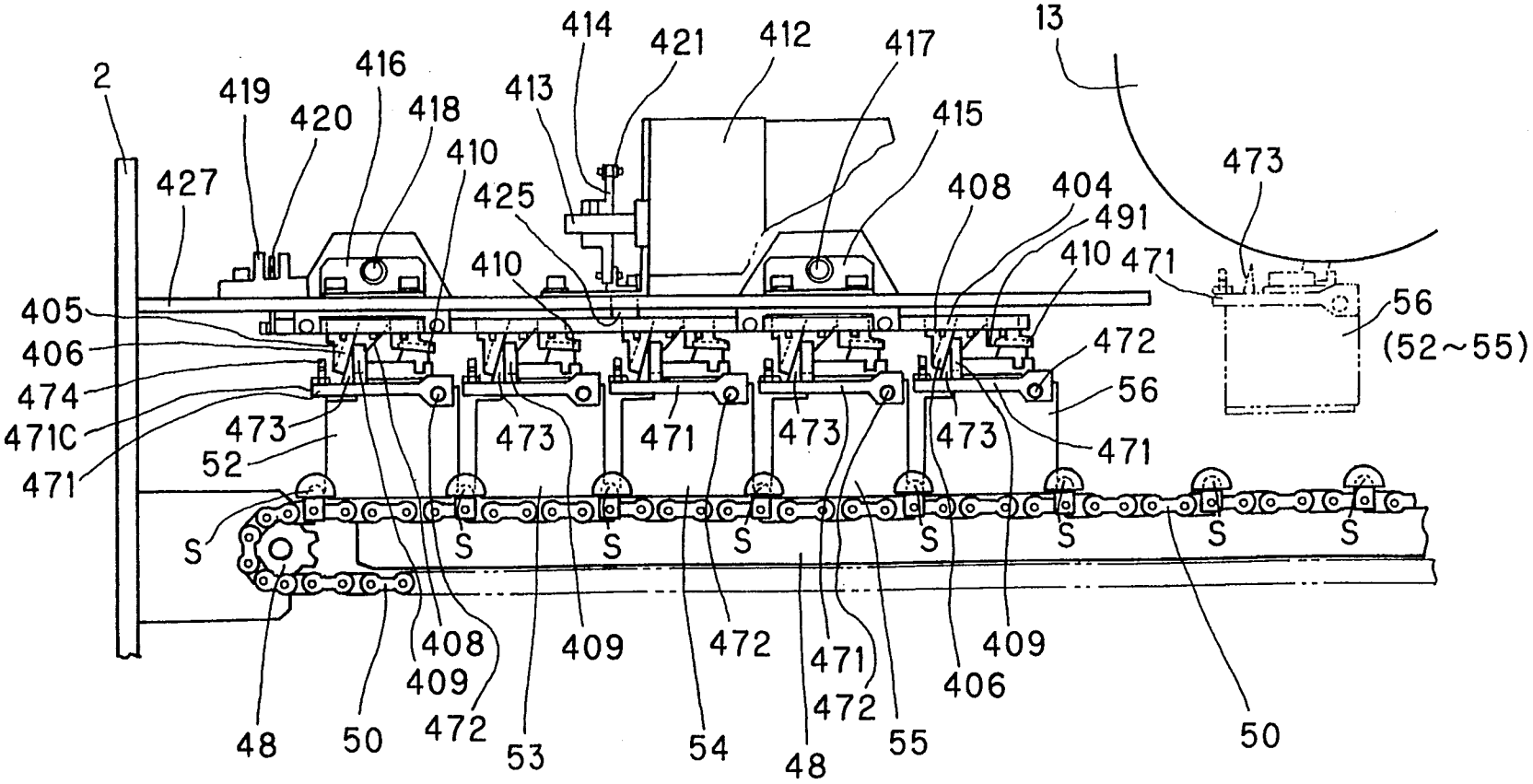
FIG. 27 is a side view of a portion of a cleaning device for a wet type developing portion of the present image recording apparatus.

In FIG. 27, a sprocket 414 for driving a chain 421 is mounted on an output shaft 413 of a motor 412 which may be a geared motor provided on a support plate 427 fixed to the side plate 2 of the apparatus.

Figure 28:
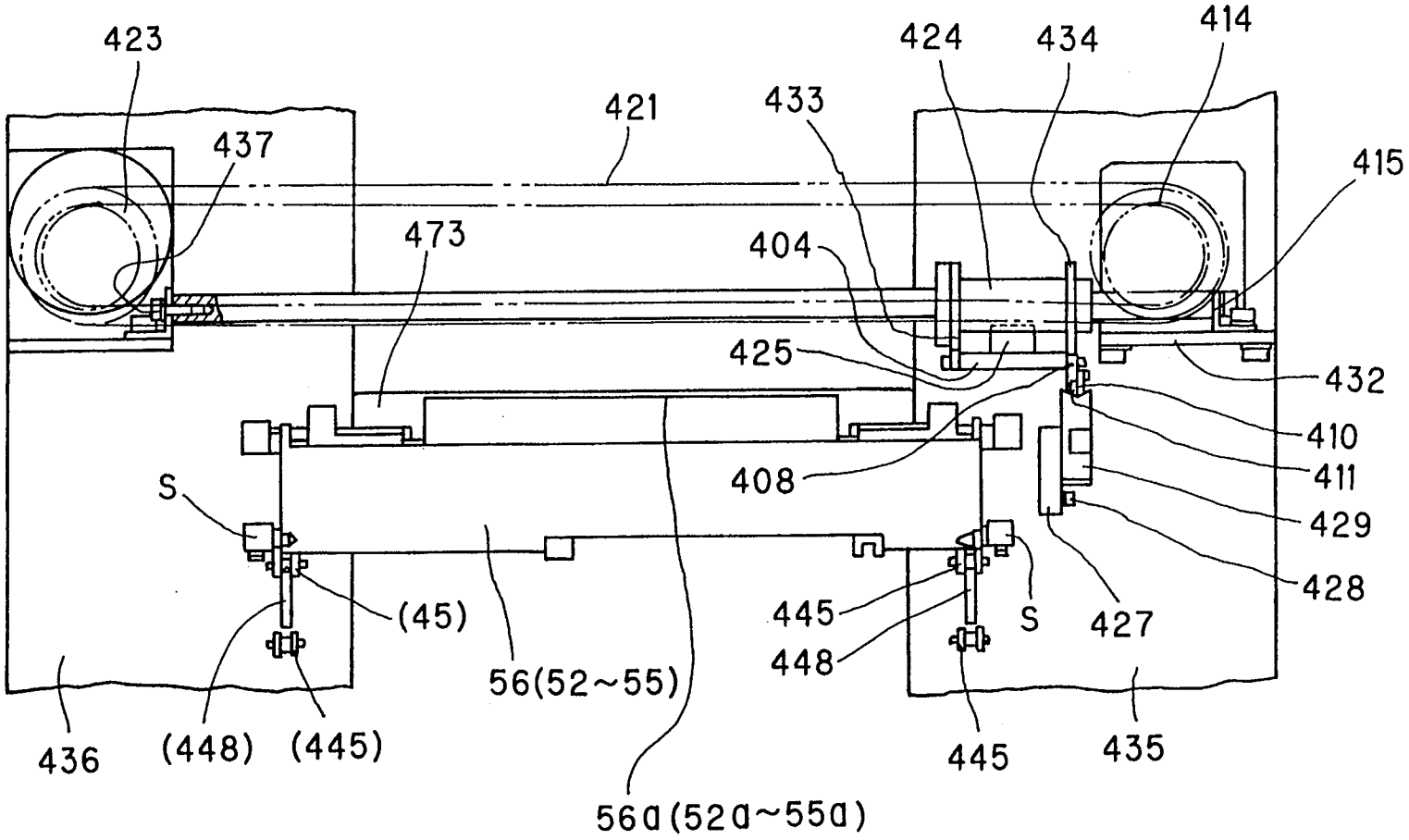
FIG. 28 is a front view of a portion of the cleaning device of the present wet type image recording apparatus.

The chain 421 extends between the sprocket 414 and a driven sprocket 423 shown in FIG. 28, perpendicularly to the previously mentioned chain 50 in FIG. 1.

On the chain 421, connecting members 425 are provided on which blade fixing plates 404 are provided, respectively.

The blade fixing plate 404 is fixedly secured to a bushing 424 by means of a pair of connecting plates 433 and 434 as shown in FIG. 28 and the bushings 424 engage with a guide rod 417 (418) movably.

Therefore, when the motor 412 is rotated to drive the driving sprocket 414 mounted on its output shaft 413, the chain 421 moves between the side plates 436 and 435, that is, perpendicularly to the chain 50 in FIG. 27.

Thus, the blade fixing plate 404 connected to the chain 421 through the connecting member 425 is guided by the guide rods 417 and 418 moves perpendicularly to the chain 50.

Reference numerals 415 and 416 are support members for one ends of the guide rods 417 and 418 and the other ends of the guide rods 417 and 418 are supported by a support member 437. (In this figure, a support member for the other end portion of the guide rod 418 is not shown).

The wet type developing devices 52 to 56 are positioned at the respective home positions on the blade fixing plate 404 as shown in FIG. 27.

There are blades 411 (FIG. 29) for cleaning the surfaces of developing electrodes 52*a* to 56*a* of the developing devices 52 to 56 and blades 406 and 409 (FIG. 29) for cleaning the blades 473 used for removal of excess developer provided separately.

Figure 29:
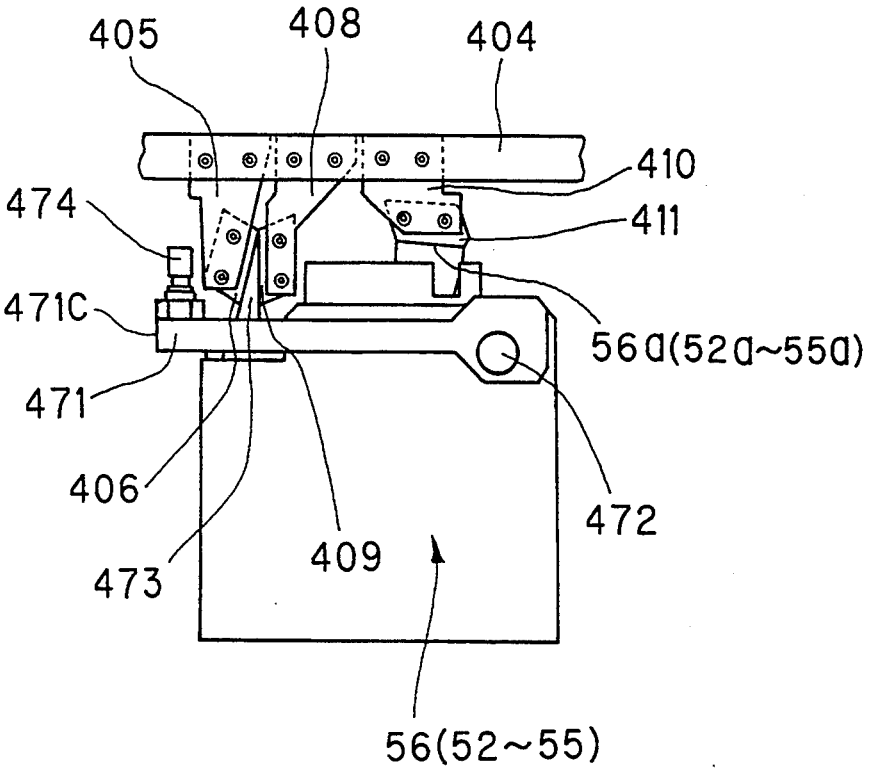
FIG. 29 is an enlarged side view of a portion of the cleaning device in FIG. 27, explaining a cleaning operation.

That is, blade mounting plates 410, 408 and 405 are fixed to the blade fixing plate 404 as shown in FIG. 29.

Blades 411 of such as rubber are mounted on the blade mounting plate 410 for separately cleaning the developing electrode surfaces 52*a* to 56*a* of the developing devices 52 to 56.

The blades 406 and 409 of such as rubber are mounted on the blade mounting plates 405 and 408 for separately cleaning the blades 473 provided for removal of excess developer on the developing devices 52 to 56.

Therefore, when the chain 421 is reciprocates by rotation of the motor 412, the blade fixing plates 404 connected to the chain 421 through the connecting members 426 reciprocate along the guide rod 417 as shown in FIG. 28.

In this case, the blades 411, 406 and 409 mounted on the blade mounting plates 410, 408 and 405 fixed to the blade fixing plate 404, which are in slidable contact with the surfaces of the members to be cleaned, reciprocate thereon to perform acceptable cleaning operation.

The blades 411 for cleaning the surfaces of the developing electrodes 52*a* to 56*a* and the blades 406 and 409 for cleaning the blades 473 for excess developer removal are in their rest positions shown in FIG. 28 when they are out of operation.

The blades 411, 406 and 409 in their rest states are in contact with a rest member 429 which is fixedly secured to the fixing portion 427 of the apparatus by screws 428.

The rest member 429 is of porous material such as sponge which can absorb electro-photographic developer attached to the respective blades 411, 406 and 409, etc., to prevent toner from being dried thereon.

In a case where surfaces of the developing electrodes 52*a* to 56*a* and the blade 473 used for removing excess developer are to be cleaned by these blades in their rest positions after the development is completed, it is preferable, in order to improve the cleaning performance, to apply a voltage having the same polarity as that of charges on the developer particles containing coloring agent and binder, etc., and dispersed in the electrically insulating liquid to the members to be cleaned during the cleaning operation to thereby generate repulsive force between these members and the developer particles.

In a case where a multi-color development is performed in the image recording apparatus, the above mentioned cleaning operation is repeated for the respective colors by moving every developing device to its home position. Alternatively, it is possible to perform the cleaning operation of the respective developing electrodes simultaneously after the development for all of the colors is completed, by circulating developer through even developing devices other than that under development while applying voltage having same polarity as that of the developer particles thereto and moving them to their home positions simultaneously.

In a case where the cleaning blades are reciprocated while supplying developer to the image recording apparatus during the cleaning operation, surfaces of the members to be cleaned are wetted with the developer, so that removal of developer fixed onto these surfaces by means of the elastic blades is facilitated.

In this case, developer scraped by the blades is washed by the supplied developer and the scraped developer is returned to the tank where it is stirred and dissolved in the electrically insulating liquid.

In this case, it is preferable that the supply of developer is stopped after one reciprocation of the cleaning blade and the cleaning operation is performed by a next reciprocation of the cleaning blade.

What is claimed is:

1. An image recording apparatus for recording an image on an electro-photographic recording sheet by forming an electric charge image corresponding to an image to be recorded on said electro-photographic recording sheet and developing said electric charge image by a wet type developer containing developer particles dispersed in an electrically insulating liquid, said image recording apparatus comprising:

a rotary drum for carrying said electro-photographic recording sheet wound thereon;

means for leading a leading edge of said electro-photographic recording sheet supplied from a supply portion having a roll of said electro-photographic recording sheet and intimately holding said electro-photographic recording sheet cut to a predetermined size on said rotary drum;

an electric charger for uniformly charging said electro-photographic recording sheet wound on said rotary drum;

exposing means having an exposing portion for exposing, through an optical system, said uniformly charged electro-photographic recording sheet to a predetermined spot light obtained by intensity-modulating a laser light with predetermined exposing data containing a spot matrix image digital data, said exposing portion disposed in an upstream region in a rotating direction of said rotary drum with respect to a lower extreme portion thereof and generally opposing an upper portion of said rotary drum;

a pre-bath treatment portion provided in a position between said upper portion where said exposing means is disposed and the lower extreme portion of the rotary drum, said pre-bath treatment portion comprising at least a supply section provided at a high level position for dropping pre-bath liquid and a pre-bath coating section provided in a vicinity of said rotary drum for coating the pre-bath liquid on the electro-photographic recording sheet by receiving the pre-bath liquid dropped from said supply section, whereby the electro-photographic recording sheet is pre-bathed by using high insulating liquid having phase solubility with electrically insulating liquid used as a wet type developer;

a developing portion having developing electrode means disposed substantially close to said rotary drum and being upstream of said lower extreme portion of said rotary drum;

an excess developer removing portion disposed on a downstream side with respect to said lower extreme portion of said rotary drum for removing an excess amount of said developer in the vicinity of said developing electrode provided in said exposing portion by air pressure;

a fixing portion;

a residual charge removing portion;

means for separating said recorded electro-photographic recording sheet from said rotary drum; and a controller for controlling operations of said rotary drum, said loading means, said electric charger, said exposing means, said pre-bath treatment portion, said developing portion, said excess developer removing portion, said fixing portion, said residual charge removing portion and said separating means.

2. The image recording apparatus claimed in claim 1, wherein said pre-bath treatment portion comprises:

a supply portion for dropping pre-bath liquid; and a painting portion disposed in the vicinity of said rotary drum for coating said electro-photographic recording sheet with said dropped pre-bath liquid, and wherein said pre-bath treatment portion is disposed between said exposing portion and said developing portion arranged in the order and said pre-bath treatment portion, said exposing portion and said developing portion are disposed in an area of an upstream half of said rotary drum with respect to said lower extreme portion thereof.

3. The image recording apparatus claimed in claim 2, wherein said painting portion includes a roller in contact with said electro-photographic recording sheet for coating said electro-photographic recording sheet with said pre-bath liquid.

4. The image recording apparatus claimed in claim 2, wherein said painting portion includes a roller supported with a constant minute gap with respect to said electro-photographic recording sheet for coating said electro-photographic recording sheet with said pre-bath liquid through said minute gap.

5. The image recording apparatus claimed in claim 2, wherein an area of said electro-photographic recording sheet is coated with said pre-bath liquid, said area being having a width and a length in a rotational direction of said rotary drum, at least one of said width and said length being smaller than a width or a length of said electro-photographic recording sheet.

6. The image recording apparatus claimed in claim 2, wherein said painting portion and a liquid receiving portion provided below said painting portion for receiving said pre-bath liquid are constructed as a unit and said unit is detachably mounted on said apparatus.

7. The image recording apparatus claimed in claim 2, further comprising an excess developer removing portion disposed on a downstream side with respect to said lower extreme portion of said rotary drum for removing an excess amount of said developer in the vicinity of said developing electrodes provided in said exposing portion by air pressure.

8. The image recording apparatus claimed in claim 2, wherein said developing electrodes are positioned at least substantially in an area upstream with respect to said lower extreme portion of said rotary drum, and further comprising an air conduit disposed in the vicinity of an upstream side of said developing electrodes for blowing air supplied from an air supply device.

9. The image recording apparatus claimed in claim 8, wherein a distance between said developing electrode and said air conduit is selected such that there is no accumulation of said developer therebetween and there is no invasion of said developer into said air conduit.

10. The image recording apparatus claimed in claim 8, further comprising air branching means for branching air produced by said air supply device to supply air to a developer particle fixing device and said air conduit.

11. The image recording apparatus claimed in claim 2, wherein a downstream side surface of said developing electrode makes an obtuse angle with respect to a tangential plane at an outer periphery of said rotary drum immediately above said downstream side surface.

12. The image recording apparatus claimed in claim 1, wherein a plurality of different wet type developers are used and a recorded electro-photographic recording sheet for proof is obtained by repeating an image recording operation performed for a single electro-photographic recording sheet a corresponding number of times to the number of said different wet type developers.

13. The image recording apparatus claimed in claim 1, wherein a recorded electro-photographic recording sheet for proof and a recorded electro-photographic recording sheet for printing plate are obtained by using electro-photographic recording sheets of an identical kind.

14. The image recording apparatus claimed in claim 1, wherein a fixing portion for a recorded electro-photographic recording sheet for printing plate is provided in a sheet discharge process.

15. The image recording apparatus claimed in claim 1, wherein said electro-photographic recording sheet includes an electrically conductive support and a photo-sensitive layer provided thereon, said photo-sensitive layer containing photo-conductive titanium dioxide dispersed in an insulating resin binder.

16. The image recording apparatus claimed in claim 1, further comprising:

a leading edge position restricting member disposed on an upper extreme position of said rotary drum for positioning a leading edge of said electro-photographic recording sheet in an axial direction in the vicinity of an upper portion of said rotary drum in a downstream side thereof;

a recording sheet pressing roller fixedly mounted on a rotary shaft extending axially of said rotary drum at a specific position in the upstream side of said rotary drum in the vicinity of said leading edge position restricting member, said recording sheet pressing roller being separable from said rotary drum in conjunction with a positioning operation of said leading edge position restricting member;

a vacuum attracting portion provided in said rotary drum for attracting the leading edge portion and a trailing portion of said recording sheet whose leading edge position is limited by said leading edge position restricting member onto a peripheral surface of said rotary drum; and means for separating said leading edge position restricting member from the surface of said rotary drum after said leading edge of said recording sheet is vacuum attracted onto the outer peripheral surface of said rotary drum, rotating said rotary drum such that said recording sheet pressed onto the peripheral surface of said rotary drum by said recording sheet pressing roller is intimately wound thereon and vacuum-attracting said trailing edge of said recording sheet.

17. The image recording apparatus claimed in claim 1, wherein said rotary drum includes:

a leading edge attracting area defined in a periphery of said rotary drum, for a leading edge position of said recording sheet of various sizes in common, said leading edge attracting area having a shallow groove extending in parallel to an axial direction of said rotary drum and said shallow groove having a length shorter than a width of said recording sheet of various sizes, said shallow groove having a plurality of through-holes connecting an outer surface of said periphery of said rotary drum and an internal space thereof;

a trailing edge attracting area covering respective trailing edge positions of said recording sheet of various sizes when wound on said rotary drum, said trailing edge attracting area having shallow grooves extending in parallel to an axial direction of said rotary drum and said shallow grooves having a length shorter than a width of said recording sheet of various sizes, each of said shallow grooves having a plurality of through-holes connecting said outer surface of said periphery of said rotary drum and said internal space;

first air suction means provided in said internal space of said rotary drum and connected to said shallow groove in said leading edge attracting area through said plurality of through-holes for attracting said leading edge of said recording sheet:

second air suction means provided in said internal space of said rotary drum and selectively connected depending on said various sizes of said recording sheet, to said shallow grooves in said trailing edge attracting area through said plurality of through-holes.

18. The image recording apparatus claimed in claim 17, wherein said first air suction means comprising a sucking disc of elastic material.

19. The image recording apparatus claimed in claim 17, wherein said second air suction means comprising a sucking disc of elastic material provided correspondingly to each of said plurality of through-holes in one of said shallow grooves in said trailing edge attracting area, and said second air suction means moving to select said one of shallow grooves in said trailing edge attracting area.

20. The image recording apparatus claimed in claim 1, further comprising a cleaning device for cleaning said wet type developing portion, said cleaning device comprising:

means for moving said wet type developing device from a position in which a development is performed to a predetermined position after the development is completed; and means for reciprocating blades of elastic material provided in said predetermined position of said wet type developing portion slidably on electrode surfaces of said developing electrodes of said wet type developing portion between opposite ends of said electrode surface of said developing electrode.

* * * * *